US006007401A

United States Patent [19]

Cyrus et al.

[11] Patent Number: 6,007,401

[45] Date of Patent: Dec. 28, 1999

[54] OPTOELECTRIC REMOTE CONTROL APPARATUS FOR GUIDING TOY VEHICLES

[75] Inventors: Peter Cyrus, Seattle, Wash.; Peter M. Maksymuk, IV; Leo M. Fernekes, both of New York, N.Y.; Stefan Rublowsky, Brooklyn, N.Y.; Eduard Kogan, Howard Beach, N.Y.; Scott J. Kolb; Eric S. Moore, both of New York, N.Y.; Dmitriy Yavid, Brooklyn, N.Y.; Christopher S. Cosentino, Staten Island, N.Y.

[73] Assignee: Parvia Corporation, Seattle, Wash.

[21] Appl. No.: 08/943,540

[22] Filed: Oct. 3, 1997

[51] Int. Cl.[6] ..... A63H 18/08

[52] U.S. Cl. ..... 446/175; 446/444; 446/454

[58] Field of Search ..... 446/175, 441, 446/444, 445, 454, 455, 456

[56] References Cited

U.S. PATENT DOCUMENTS

| | | | |
|---|---|---|---|
| D. 304,484 | 11/1989 | Knudsen . | |
| D. 306,188 | 2/1990 | Tapdrup et al. . | |
| D. 306,190 | 2/1990 | Poulsen . | |
| D. 307,775 | 5/1990 | Pedersen . | |
| D. 366,914 | 2/1996 | Frederiksen . | |
| D. 367,896 | 3/1996 | Knudsen . | |
| D. 367,897 | 3/1996 | Schmidt et al. . | |
| 1,393,163 | 10/1921 | Rasely . | |
| 2,106,424 | 1/1938 | Einfalt . | |
| 2,115,108 | 4/1938 | Horn | 446/455 |
| 2,188,293 | 1/1940 | Williams . | |
| 2,637,140 | 5/1953 | Hoff . | |
| 2,671,662 | 3/1954 | Carpenter et al. | 446/454 |
| 2,674,813 | 4/1954 | Hutchinson . | |
| 2,690,626 | 10/1954 | Gay et al. . | |
| 2,866,418 | 12/1958 | Petrick, Sr. | 446/444 |
| 2,871,619 | 2/1959 | Walters . | |
| 2,903,821 | 9/1959 | Favre . | |
| 2,942,354 | 6/1960 | Grain . | |
| 3,005,282 | 10/1961 | Christiansen . | |
| 3,025,626 | 3/1962 | Schumacher . | |
| 3,034,254 | 5/1962 | Christiansen . | |
| 3,121,971 | 2/1964 | Nyc . | |
| 3,147,817 | 9/1964 | De Liban | 446/455 |
| 3,162,973 | 12/1964 | Christiansen . | |
| 3,234,683 | 2/1966 | Christiansen . | |
| 3,236,004 | 2/1966 | Christiansen . | |
| 3,242,610 | 3/1966 | Christiansen . | |
| 3,284,946 | 11/1966 | Christiansen . | |
| 3,352,054 | 11/1967 | Glass et al. . | |
| 3,403,470 | 10/1968 | Werner . | |
| 3,444,646 | 5/1969 | Domashovetz | 446/175 |
| 3,453,970 | 7/1969 | Hansen . | |
| 3,461,601 | 8/1969 | Kristiansen . | |
| 3,475,851 | 11/1969 | Christiansen . | |

(List continued on next page.)

FOREIGN PATENT DOCUMENTS

| | | | |
|---|---|---|---|
| 2 674 141 | 9/1992 | France . | |
| 2735521 | 2/1979 | Germany | 446/455 |
| 4-8384 | 1/1992 | Japan . | |
| 2099712 | 12/1982 | United Kingdom | 446/441 |
| 2235137 | 2/1991 | United Kingdom | 446/456 |

*Primary Examiner*—Robert A. Harfer
*Assistant Examiner*—Jeffrey D. Carlson
*Attorney, Agent, or Firm*—Christensen O'Connor Johnson & Kindness PLLC

[57] ABSTRACT

The present invention is a control apparatus for guiding toy vehicles on a roadway. Preferably, a remote control hand unit is employed that is most preferably optoelectric. The hand unit includes a plurality of direction keys that transmit signals from the hand unit based on their electronic interconnection with an infrared LED and a laser transmitter in the hand unit. The hand unit transmits directional commands to control movement of a toy vehicle through the intersection of a roadway. These control commands are transmitted via a modulated infrared signal that is received by an infrared sensor adjacent the roadway. Additionally, the hand unit transmits a location laser signal to one of many reception points, i.e., laser detectors, located adjacent each road at an intersection.

21 Claims, 19 Drawing Sheets

U.S. PATENT DOCUMENTS 3,584,410 6/1971 Lalonde .
3,596,401 8/1971 Camire .
3,597,858 8/1971 Ogsbury .
3,597,875 8/1971 Christiansen .
3,667,153 6/1972 Christiansen .
3,734,433 5/1973 Metzner .
3,742,620 7/1973 Knoll .
3,981,506 9/1976 Daniel et al. .
4,028,844 6/1977 Dideriksen et al. .
4,168,760 9/1979 Paul, Jr. et al. .
4,176,493 12/1979 Dideriksen .
4,185,410 1/1980 Kristiansen .
4,203,248 5/1980 Tapdrup .
4,205,482 6/1980 Christiansen et al. .
4,214,403 7/1980 Knudsen .
4,245,400 1/1981 Johnson .
4,403,733 9/1983 Bach et al. .
4,430,063 2/1984 Bach et al. .
4,430,826 2/1984 Ryaa .
4,461,116 7/1984 Bach .
4,556,393 12/1985 Bolli .
4,563,162 1/1986 Ishimoto .
4,579,041 4/1986 Organ et al. .
4,589,702 5/1986 Bach et al. .
4,602,334 7/1986 Salesky .
4,685,884 8/1987 Rohan .
4,715,832 12/1987 Bach .
4,726,515 2/1988 Bolli et al. .
4,743,202 5/1988 Bach .
4,828,525 5/1989 Okano ..... 446/175
4,846,750 7/1989 Tapdrup .
4,854,742 8/1989 Bach .
4,861,306 8/1989 Bolli et al. .
4,865,575 9/1989 Rosenthal ..... 446/175
4,874,176 10/1989 Auerbach .
4,883,440 11/1989 Bolli .
4,894,040 1/1990 Bach et al. .
4,897,066 1/1990 Tapdrup et al. .
4,937,181 6/1990 Rogers .
4,938,483 7/1990 Yavetz .
4,978,301 12/1990 Dodge .
4,988,322 1/1991 Knudsen .
4,988,324 1/1991 Ryaa et al. .
4,992,069 2/1991 Bolli et al. .
4,998,903 3/1991 Bolli et al. .
5,011,411 4/1991 Loewy .
5,015,210 5/1991 Dideriksen .
5,042,972 8/1991 Bach et al. .
5,049,078 9/1991 Thomsen .
5,049,104 9/1991 Olsen .
5,071,384 12/1991 Poulsen .
5,087,001 2/1992 Bolli et al. .
5,094,643 3/1992 Bolli et al. .
5,112,263 5/1992 Penillard et al. .
5,251,900 10/1993 Gallant .
5,304,086 4/1994 Bolli et al. .
5,322,466 6/1994 Bolli et al. .
5,326,267 7/1994 Brokaw .
5,348,478 9/1994 Bradshaw .
5,349,734 9/1994 Poulsen et al. .
5,360,364 11/1994 Poulsen et al. .
5,373,791 12/1994 Bach et al. .
5,378,191 1/1995 Ryaa .
5,380,232 1/1995 Berggreen et al. .
5,387,148 2/1995 Dideriksen et al. .
5,417,603 5/1995 De Chazal .
5,427,530 6/1995 Taggart .
5,427,558 6/1995 Knudsen et al. .
5,452,901 9/1995 Nakada et al. .
5,494,471 2/1996 Ryaa et al. .
5,580,295 12/1996 Ruzskai et al. .
5,596,181 1/1997 Bach et al. .
5,643,038 7/1997 Olsen et al. .
5,645,463 7/1997 Olsen .
5,749,547 5/1998 Young et al. ..... 446/455
5,774,069 6/1998 Tanaka et al. .

OPTOELECTRIC REMOTE CONTROL APPARATUS FOR GUIDING TOY VEHICLES

FIELD OF THE INVENTION

The invention relates to the guidance of toy vehicles and, more particularly, optoelectric remote control guidance thereof.

BACKGROUND OF THE INVENTION

U.S. Pat. No. 1,084,370 discloses an educational apparatus having a transparent sheet of glass laid over a map or other illustration sheet that is employed as a surface on which small moveable figures are guided by the movement of a magnet situated below the illustration sheet. Each figure, with its appropriate index word, figure or image is intended to arrive at an appropriate destination on the top of the sheet and to be left there temporarily.

U.S. Pat. No. 2,036,076 discloses a toy or game in which a miniature setting includes inanimate objects placeable in a multitude of orientations on a game board and also includes animate objects having magnets on their bottom portions. A magnet under the game board is employed to invisibly cause the movement of any of the selected animate objects relative to the inanimate objects.

U.S. Pat. No. 2,637,140 teaches a toy vehicular system in which magnetic vehicles travel over a toy landscape as they follow the movement of ferromagnetic pellets through an endless nonmagnetic tube containing a viscous liquid such as carbon tetrachloride. The magnetic attraction between the vehicles and ferromagnetic pellets carried by the circulating liquid is sufficient to pull the vehicles along the path defined by the tube or channel beneath the playing surface.

U.S. Pat. No. 3,045,393 teaches a device with magnetically moved pieces. Game pieces are magnetically moved on a board by reciprocation under the board of a control slide carrying magnetic areas or elements longitudinally spaced apart in the general direction of the motion path. The surface pieces advance step-by-step in one direction as a result of the back and forth reciprocation of the underlying control slide.

U.S. Pat. No. 4,990,117 discloses a magnetic force-guided traveling toy wherein a toy vehicle travels on the surface of a board, following a path of magnetically attracted material. The toy vehicle has a single drive wheel located centrally on the bottom of the vehicle's body. The center of the gravity of the vehicle resides substantially over the single drive wheel so that the vehicle is balanced. A magnet located on the front of the vehicle is attracted to the magnetic path on the travel board. The magnetic attraction directly steers the vehicle around the central drive wheel along the path.

SUMMARY OF THE INVENTION

The present invention is a control apparatus for guiding toy vehicles on a roadway. Preferably, a remote control hand unit is employed that is most preferably optoelectric. The hand unit includes a plurality of direction keys that transmit signals from the hand unit based on their electronic interconnection with an infrared LED and a directional light source, such as laser transmitter in the hand unit. The hand unit transmits directional commands to control movement of a toy vehicle through the intersection of a roadway. These control commands are transmitted via a modulated infrared signal that is received by an infrared sensor adjacent the roadway. Additionally, the hand unit transmits a location laser signal to one of many reception points, i.e., laser detectors, located adjacent each road at an intersection.

Because the infrared signal generated by the hand unit provides command signals that are omnidirectional, only a single infrared sensor needs to be present adjacent the roadway. However, the location laser signals from the hand unit are directionally specific, and when the hand unit is pointed at a specific one of the plurality of laser detectors associated with a specific road at a specific intersection, this laser detector, and only this laser detector, is activated by the hand unit.

When the infrared sensor detects a control infrared signal from the hand unit, this data is sent to a microprocessor associated with the roadway. Additionally, the specific laser detector activated by the location laser signal from the hand unit also provides an input to the microprocessor. Thus, the microprocessor is able to associate the infrared control command received from the single infrared sensor to a specific locale, i.e., specific intersection and specific roadway thereof, based upon which laser detector was activated by the laser location signal from the hand unit. The microprocessor will therefore apply the command sent by the infrared signal of the hand unit to the infrared sensor, for example, "right turn", to the specific locale with which the activated laser detector is associated.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
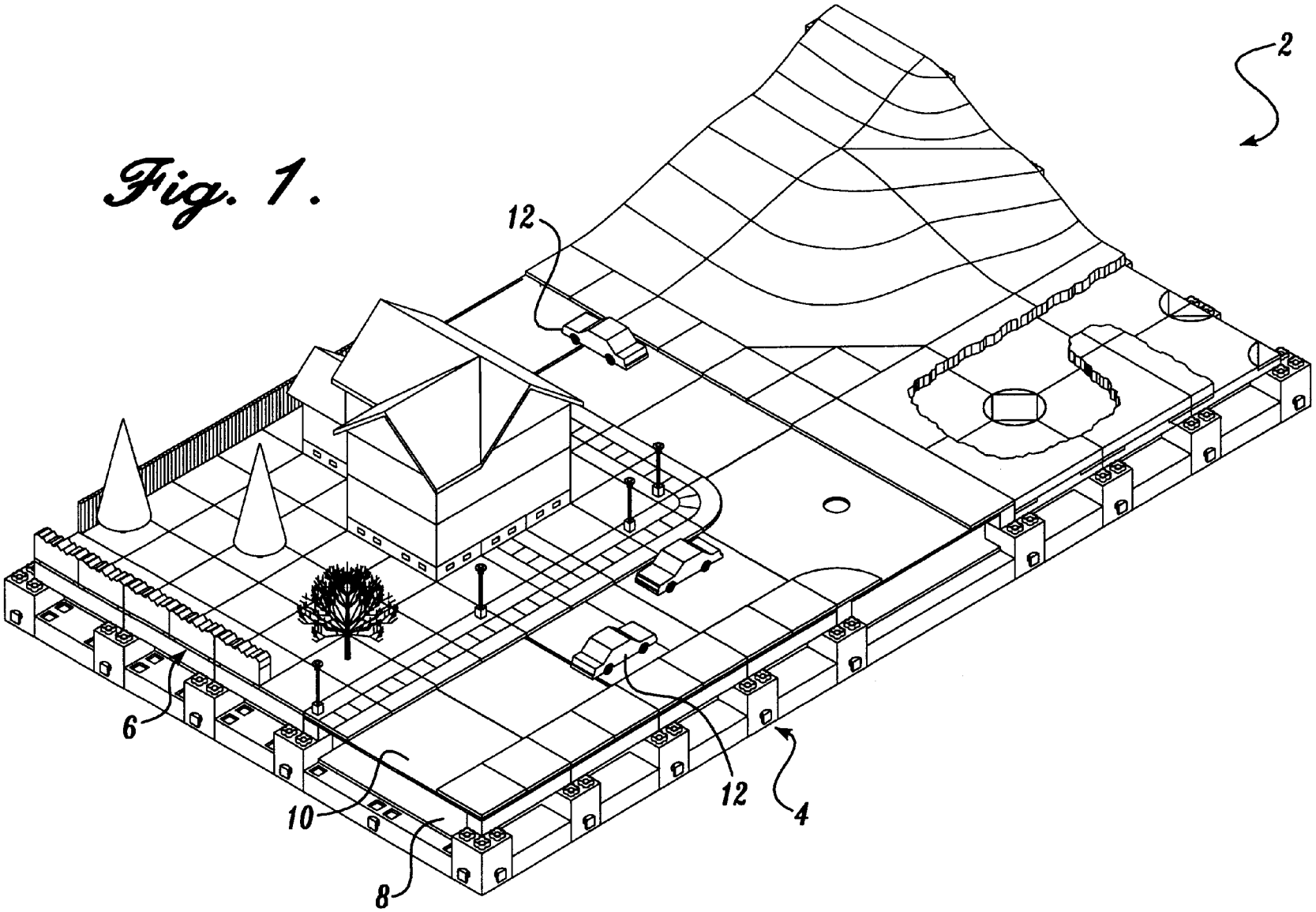
FIG. 1 is an isometric view of a toy building set including the upper roadway and lower roadway employed with the present invention.
Figure 2:
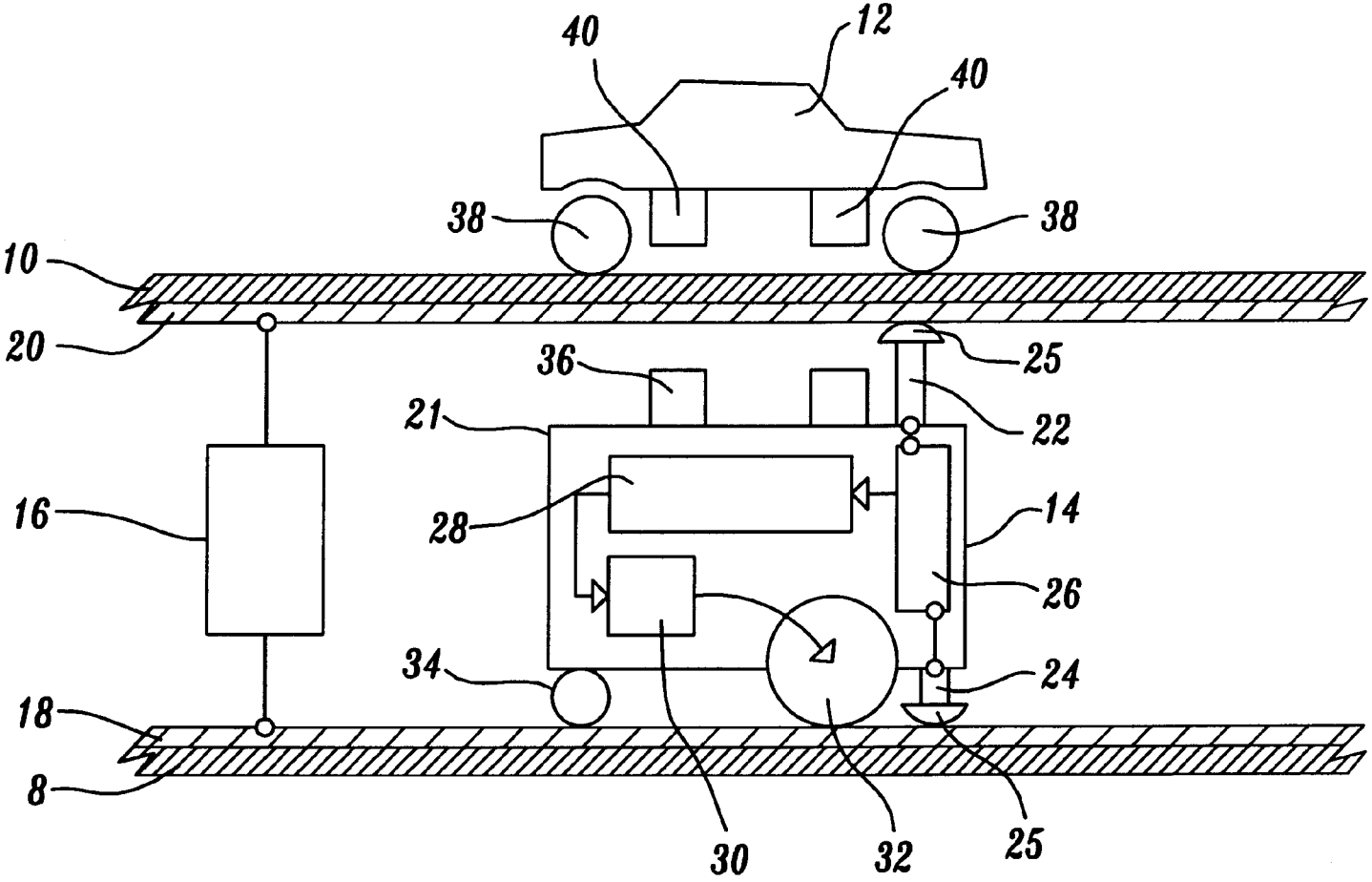
FIG. 2 is a diagrammatic section view of the upper roadway, lower roadway, surface vehicle and powered subsurface vehicle employed with the present invention.
Figure 3:
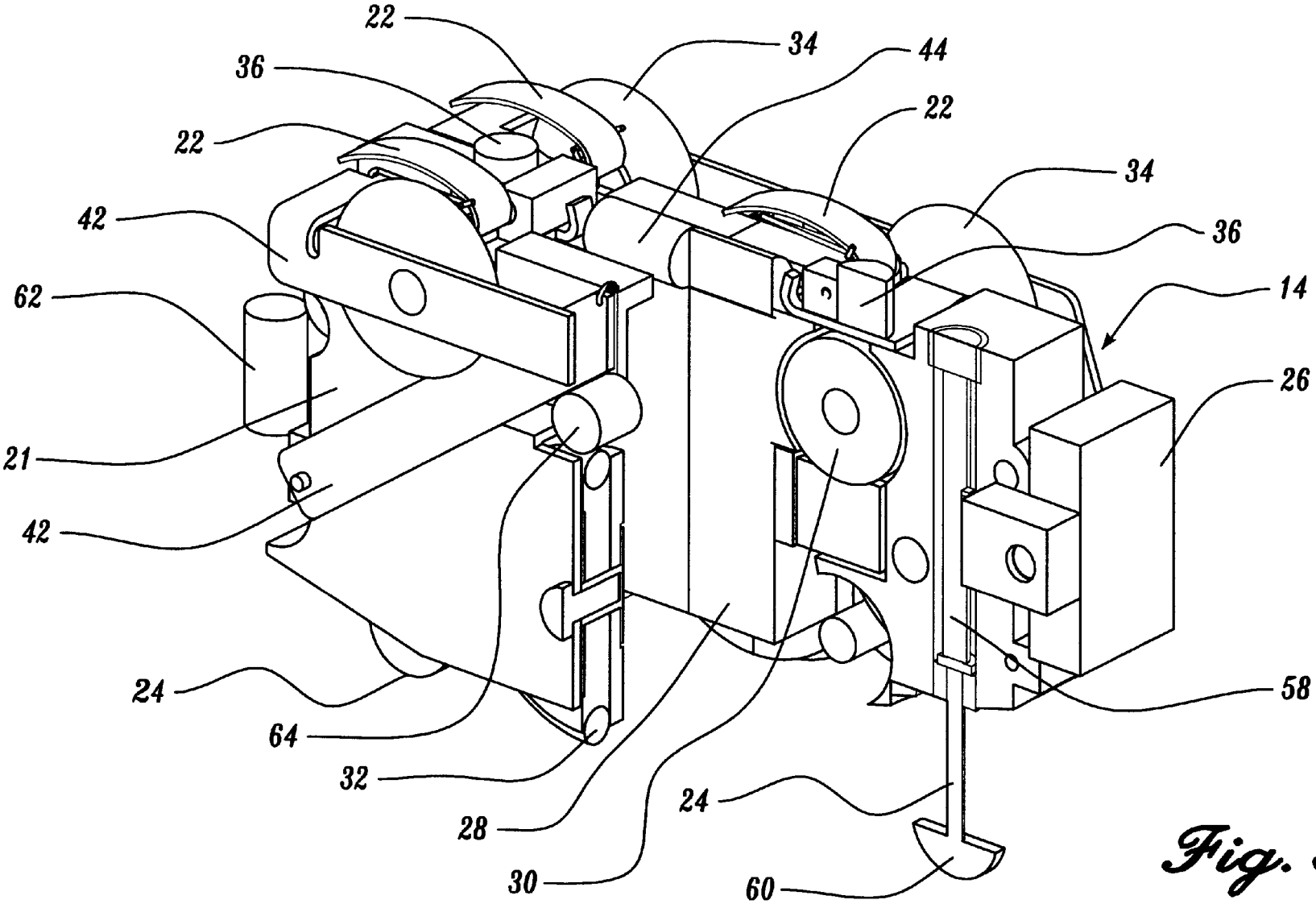
FIG. 3 is a partially exposed isometric view of the powered subsurface vehicle employed with the present invention.

The present invention is a toy vehicular remote control apparatus for guiding toy vehicles as shown and described in FIGS. 1–20. As best shown in FIG. 1, the toy vehicular guidance apparatus of the present invention can be used in a toy building set 2 having a lattice 4 and modular bases 6. More specifically, lattice 4 provides the substructure of toy building set 2 and supports modular bases 6 which are spaced above lattice 4 by a predetermined distance. Lower roadway 8 is also supported by lattice 4, but on a lower portion of lattice 4 at a predetermined distance below modular bases 6. Upper roadway 10 is comprised of some of modular bases 6 that have been specialized in design to provide a smooth traffic bearing surface for movement of surface vehicles 12 thereon. Most preferably, the road pattern of upper roadway 10 and lower roadway 8 are identical so that subsurface vehicles 14, as shown in FIGS. 2 and 3, can travel on lower roadway 8 to guide surface vehicles 12 on upper roadway 10 in a manner further described below. Preferably, the distance between lower roadway 8 secured to lattice 4 and upper roadway 10, also secured to lattice 4, is large enough to allow ingress and travel of subsurface vehicle 14 between lower roadway 8 and upper roadway 10.

Next referring to FIG. 2, the magnetic interconnection between surface vehicle 12 and subsurface vehicle 14 is shown whereby subsurface vehicle 14 travels between lower roadway 8 and upper roadway 10 such that surface vehicle 12 can be transported on upper roadway 10 by subsurface vehicle 14. As shown in FIG. 2, power supply 16 interconnects a lower conductive layer 18 and upper conductive layer 20. Lower conductive layer 18 is located on the upper side of lower roadway 8. Upper conductive layer 20 is located on the under side of upper roadway 10. Power supply 16 thus energizes lower conductive layer 18 and upper conductive layer 20. Subsurface vehicle 14 accesses the electrical power in lower conductive layer 18 and upper conductive layer 20 in a manner described below to travel on lower roadway 8. Power supply 16 can be either direct current or alternating current, of preferably a shock safe voltage level, for example, about 12 volts. Lower conductive layer 18 and upper conductive layer 20 consist of thin metal sheets, foil layers or a conductive coating that may be, for example, polymeric. The conductive sheet, coating, or composite most preferably includes copper as the conductive metal.

Still referring to FIG. 2, subsurface vehicle 14 has a chassis 21 with an upper brush 22 located on the top of chassis 21 adjacent the under side of upper roadway 10 on which upper conductive layer 20 is located. Chassis 21 also has a lower brush 24 located on the under side thereof adjacent the upper surface of lower roadway 8 on which lower conductive layer 18 is located. Upper brush 22 and lower brush 24, which can be metal, graphite or conductive plastic, provide electrical interconnection between chassis 21 of subsurface vehicle 14 and upper conductive layer 20 and lower conductive layer 18, respectively for transfer of electrical power from power supply 16 to subsurface vehicle 14. Upper brush 22 and lower brush 24 are preferably elastic or spring loaded in order to accommodate changes in the distance between upper conductive layer 20 and lower conductive layer 18 to ensure a reliable electrical connection to subsurface vehicle 14. Upper brush 22 and lower brush 24 each have a head 25 that is contoured, or in another way shaped, for low friction sliding along upper conductive layer 20 and lower conductive layer 18, respectively, when subsurface vehicle 14 is in motion. Lower conductive layer 18 and upper conductive layer 20 can be located on substantially the entire upper surface of lower roadway 8 and under side of upper roadway 10, respectively, in order to ensure electrical interconnection of subsurface vehicle 14 to power supply 16 despite lateral movement across lower conductive layer 18 and upper conductive layer 20 by subsurface vehicle 14 due to, for example, turning of subsurface vehicle 14 or uncontrolled lateral movement thereof. Alternatively, lower conductive layer 18 and upper conductive layer 20 can be located in troughs or grooves in the upper surface of lower roadway 8 and the under side of upper roadway 10, respectively, into which head 25 of lower brush 24 and head 25 of upper brush 22, respectively, can reside in order to control the tracking of subsurface vehicle 14 in an electrically conductive environment by minimizing lateral movement of subsurface vehicle 14 relative to lower roadway 8 and upper roadway 10. Upper brush 22 and lower brush 24 are both electrically connected to control circuit 26 that is located on the front of chassis 21 of subsurface vehicle 14. Generally, control circuit 26 controls the electrical functioning of subsurface vehicle 14, and more specifically controls, and is electrically interconnected with, electromotor 28. Control circuit 26 thus controls the direction of movement, acceleration, deceleration, stopping, and turning of subsurface vehicle 14 based on external control signals, or control signals generated by subsurface vehicle 14 itself. Control circuit 26 is described in further detail below in conjunction with FIG. 8. Electromotor 28, electrically interconnected with control circuit 26, can be a direct current motor with brushes, a direct current brushless motor, or a stepper motor. Blectromotor 28 is mechanically interconnected with transmission 30 that transfers rotation of electromotor 28 to drive wheel 32 employing the desired reduction ratio. More than one electromotor 28 can be employed for independent drive of a plurality of drive wheels 32. Additionally, transmission 30 can be a differential transmission to drive two or more drive wheels 32 at different speeds. In this manner, more sophisticated control of the acceleration, deceleration, and turning, for example, of subsurface vehicle 14 can be employed. Chassis support 34 is located on the under side of chassis 21 of subsurface vehicle 14. Chassis support 34 is spaced from drive wheel 32, also located on the under side of subsurface vehicle 14, and can be, for example, rollers or low friction drag plates that are preferably flexible to allow compensation for distance variation between lower roadway 8 and upper roadway 10. Magnets 36 are preferably disposed on the top of subsurface vehicle 14 adjacent the under side of upper roadway 10. Magnets 36 are preferably permanent magnets, but can also be electromagnets supplied with power from power supply 16 via control circuit 26.

Still referring to FIG. 2, surface vehicle 12, while preferably being a car, truck, or other vehicle, can be any type of device for which mobility is desired in the environment of a toy building set. Surface vehicle 12 includes wheels 38 which are rotatable to allow movement of surface vehicle 12 on upper roadway 10. Instead of wheels 38, a low friction drag plate can be employed. Magnets 40 are located on the under side of vehicle 12 adjacent upper roadway 10. Magnets 40 are sized and spaced on vehicle 12 to be aligned with magnets 36 on the top of chassis 21 of subsurface vehicle 14 for magnetic interconnection of surface vehicle 12 and subsurface vehicle 14.

Next referring to FIG. 3, a preferred embodiment of subsurface vehicle 14 is shown. Subsurface vehicle 14 of FIG. 3 is designed to move between an ABS lower roadway 8 with a lower conductive layer 18 of copper laminate and an ABS upper roadway 10 with an upper conductive layer 20 of copper lamninate. Subsurface vehicle 14 of FIG. 3 has two drive wheels 32 and four chassis supports 34 (rollers) for stability and balance. It is important to note that, unlike the embodiment of subsurface vehicle 14 of FIG. 2, the embodiment of subsurface vehicle 14 of FIG. 3 has chassis supports 34 located on the upper portion of chassis 21 of subsurface vehicle 14, instead of underneath chassis 21 of subsurface vehicle 14. The orientation of chassis supports 34, which are preferably rollers, on the upper portion of chassis 21 increases the force on drive wheels 32 to minimize slipping thereof. Chassis supports 34 are located on frames 42, and are loaded by spring 44. The above configuration assures a substantially uniform force on drive wheels 32 regardless of the clearance between lower roadway 8 and upper roadway 10, and also facilitates passage of subsurface vehicle 14 along inclines or declines of lower roadway 8 and upper roadway 10. Magnets 36 are 0.1×0.125 inch round permanent rare earth magnets with residual flux around 9,000 Gauss. Preferably, the same type of magnets are employed for magnets 40 of surface vehicle 12. Reliable magnetic coupling has been observed at a distance of up to 0.2 inches between magnets 40 of surface vehicle 12 and magnets 36 of subsurface vehicle 14. Four upper brushes 22 are preferably present and are made from copper. Upper brushes 22 are loaded by torsion springs. Two lower brushes 24 are preferably present and are also made from copper. The lower brushes 24 are loaded by spiral springs and are axially rotatable and vertically reciprocatable within channel 58 of chassis 21. Each lower brushes 24 has a widened shoe 60 on its end remote from chassis 21 that has a thickness sized to fit with troughs or grooves in the upper surface of lower roadway 8, described further below. Shoes 60 of lower brushes 24 thus can guide subsurface vehicle 14 along a predefined route. A rear magnet 62 and a side magnet 64 on each side of subsurface vehicle 14, preferably either permanent or electromagnets, are located on chassis 21 for collision avoidance with another subsurface vehicle 14 and for directional control of subsurface vehicle 14 as described further below. Electromotor 28 is preferably a direct current brush motor, for example, Mabuchi model No. SH-030SA, rated for 1.7 W maximum output at approximately 15,000 RPM at 12 volts of direct current power supply. Transmission 30 consists of one common worm stage and two separate, but identical two-stage gear trains for each of the two drive wheels 32. The total reduction ratio of transmission 30 is 1:133, and the efficiency is about 25 percent. Subsurface vehicle 14 operates at speeds of up to 4 inches per second at an incline of up to 15°.

Figure 4:
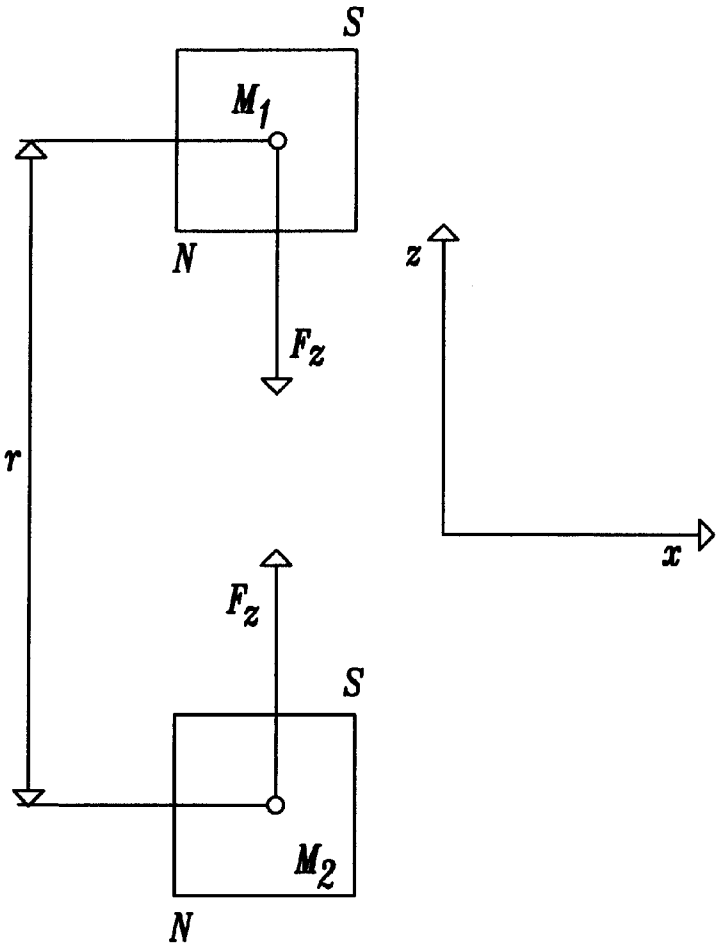
FIG. 4 is a diagrammatic section view of attractive forces between two magnets showing no offset.

Next referring to FIGS. 4–7, the principles of the magnetic forces interconnecting surface vehicle 12 and subsurface vehicle 14 by magnets 36 and magnets 40 are described. As shown in FIG. 4, when two magnets are placed one above the other, with opposite poles toward each other, a magnetic force $F_Z$ between them exhibits based on the following equation:

$$F_z \approx 6\frac{M_1 \cdot M_2}{r^4}$$

where r is the distance between parallel planes in which magnets are situated and $M_1$, $M_2$ are magnetic moments of both magnets. For permanent magnets, M is proportional to the volume of magnetic substance cross its residual flux density. For electromagnets, M is proportional to the number of turns cross the current.

Figure 5:
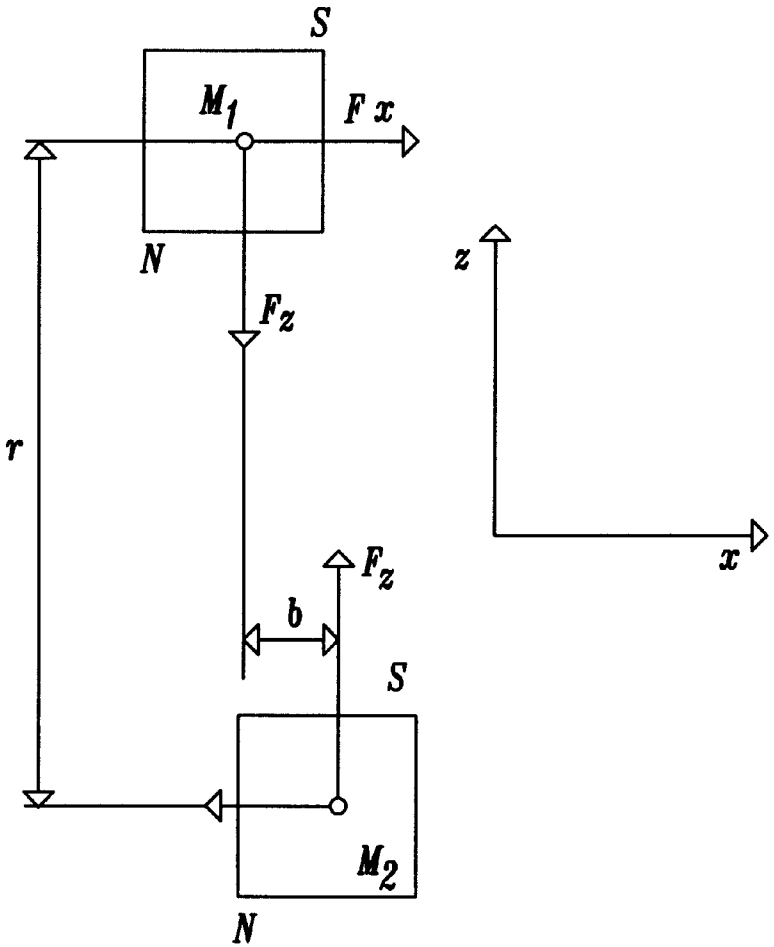
FIG. 5 is a diagrammatic section view of attractive forces between two magnets showing horizontal offset.

As shown in FIG. 5, when two magnets, one above the other, are shifted slightly to be horizontally offset by a distance b, the horizontal force $F_x$ occurs:

$$F_x \approx 6b\frac{M_1 \cdot M_2}{r^5}$$

Figure 6:
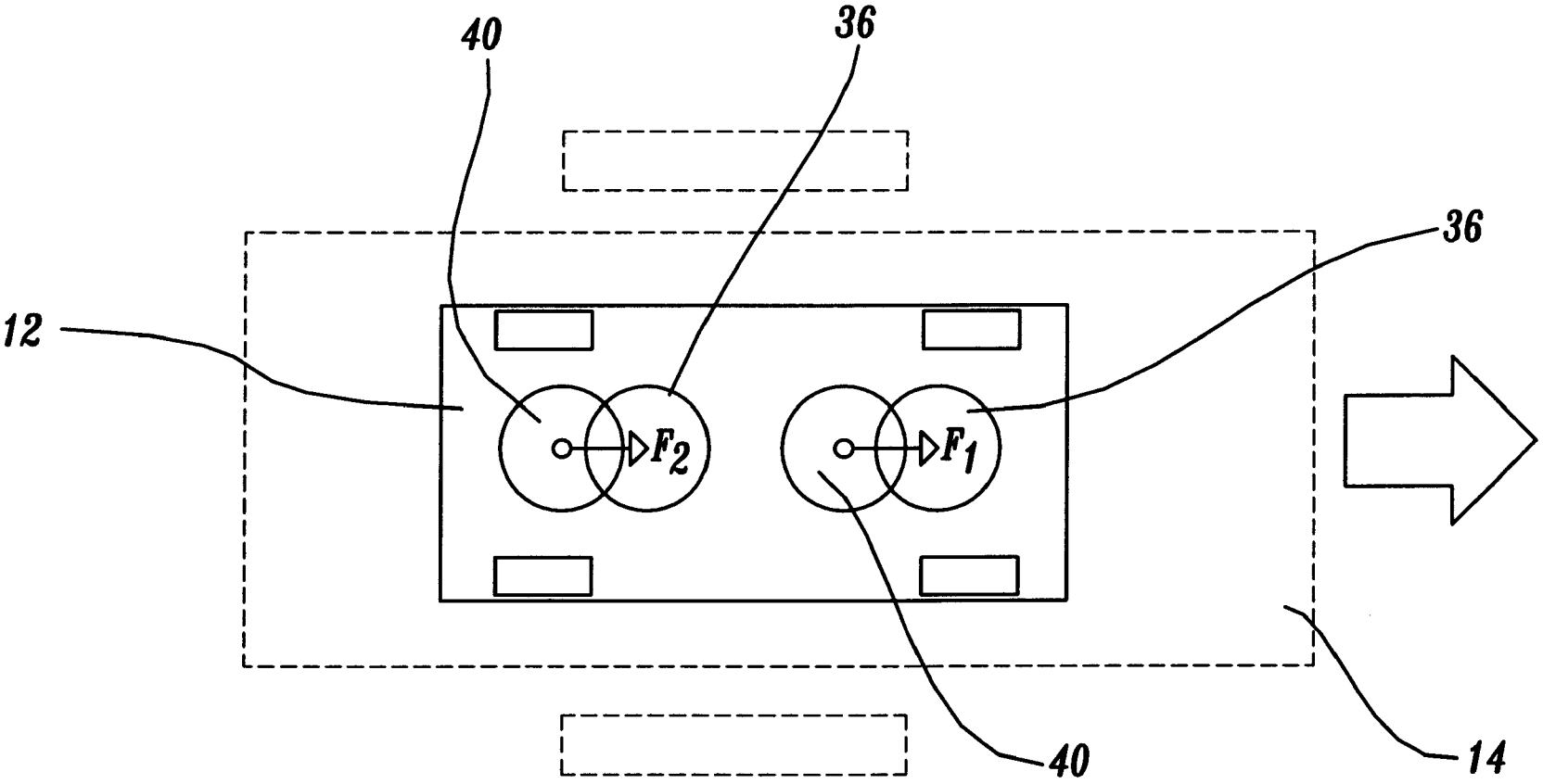
FIG. 6 is a diagrammatic plan view of the magnetic interaction between the surface vehicle and the subsurface vehicle employed with the present invention during straight movement.
Figure 7:
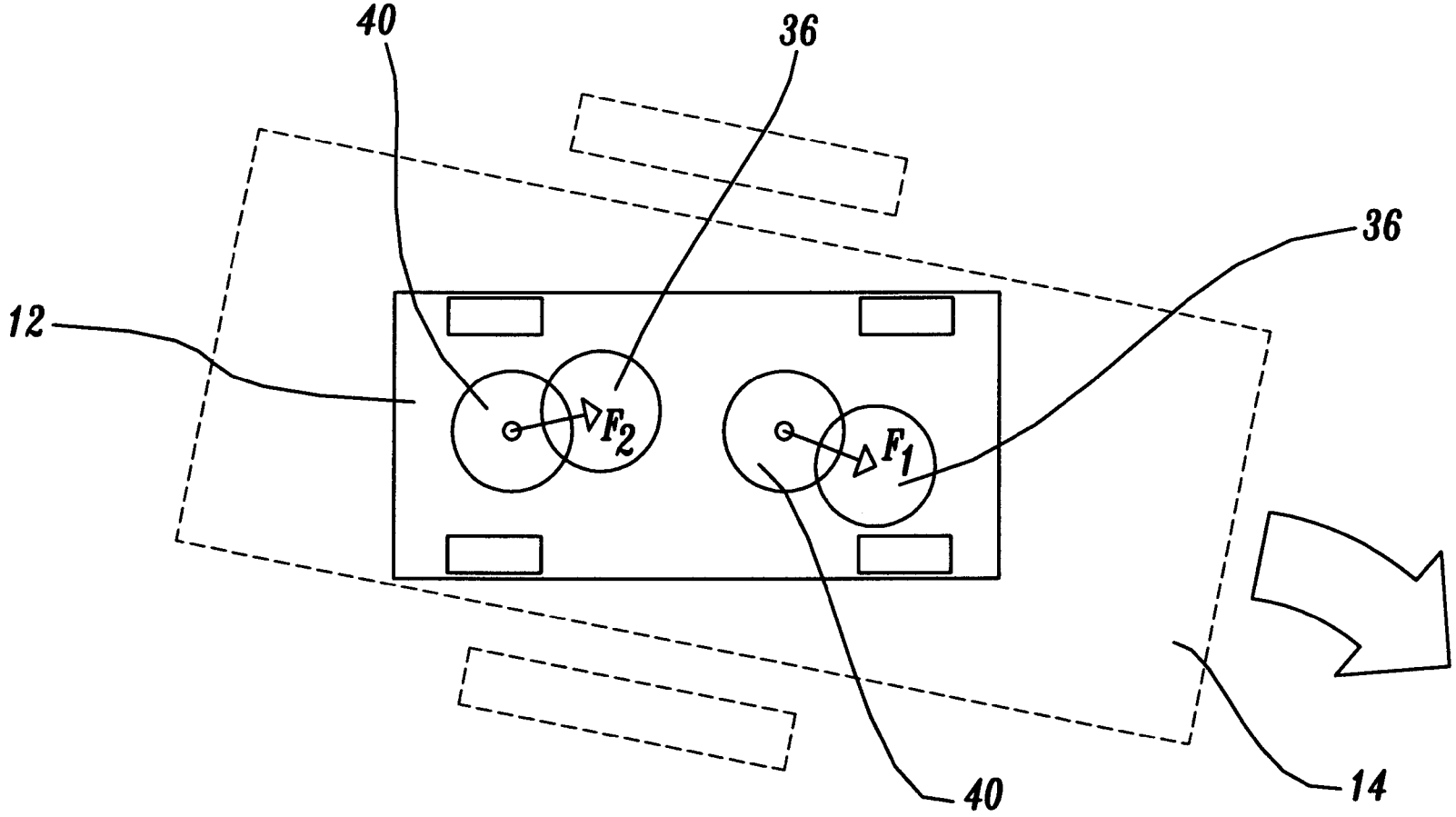
FIG. 7 is a diagrammatic plan view of the magnetic interaction between the surface vehicle and the subsurface vehicle employed with the present invention during a turn.

Next referring to FIGS. 6 and 7, the principles described above and shown in FIGS. 4 and 5 are discussed in relation to movement of nonpowered surface vehicle 12 by powered subsurface vehicle 14 due to the magnetic interconnection between magnets 40 of surface vehicle 12 and magnets 36 of subsurface vehicle 14. First referring to FIG. 6, during straight line movement, the horizontal offset b between surface vehicle 12 and subsurface vehicle 14 increases as subsurface vehicle 14 moves until forces $F_1$ and $F_2$ become large enough to overcome friction, inertia and, possibly, gravitational incline. At this point, surface vehicle 12 moves to follow subsurface vehicle 14. During a turn, as shown in FIG. 7, forces $F_1$ and $F_2$ have different directional vectors. Thus, forces $F_1$ and $F_2$ not only create thrust, but torque as well, that causes surface vehicle 12 to follow subsurface vehicle 14.

Figure 8:
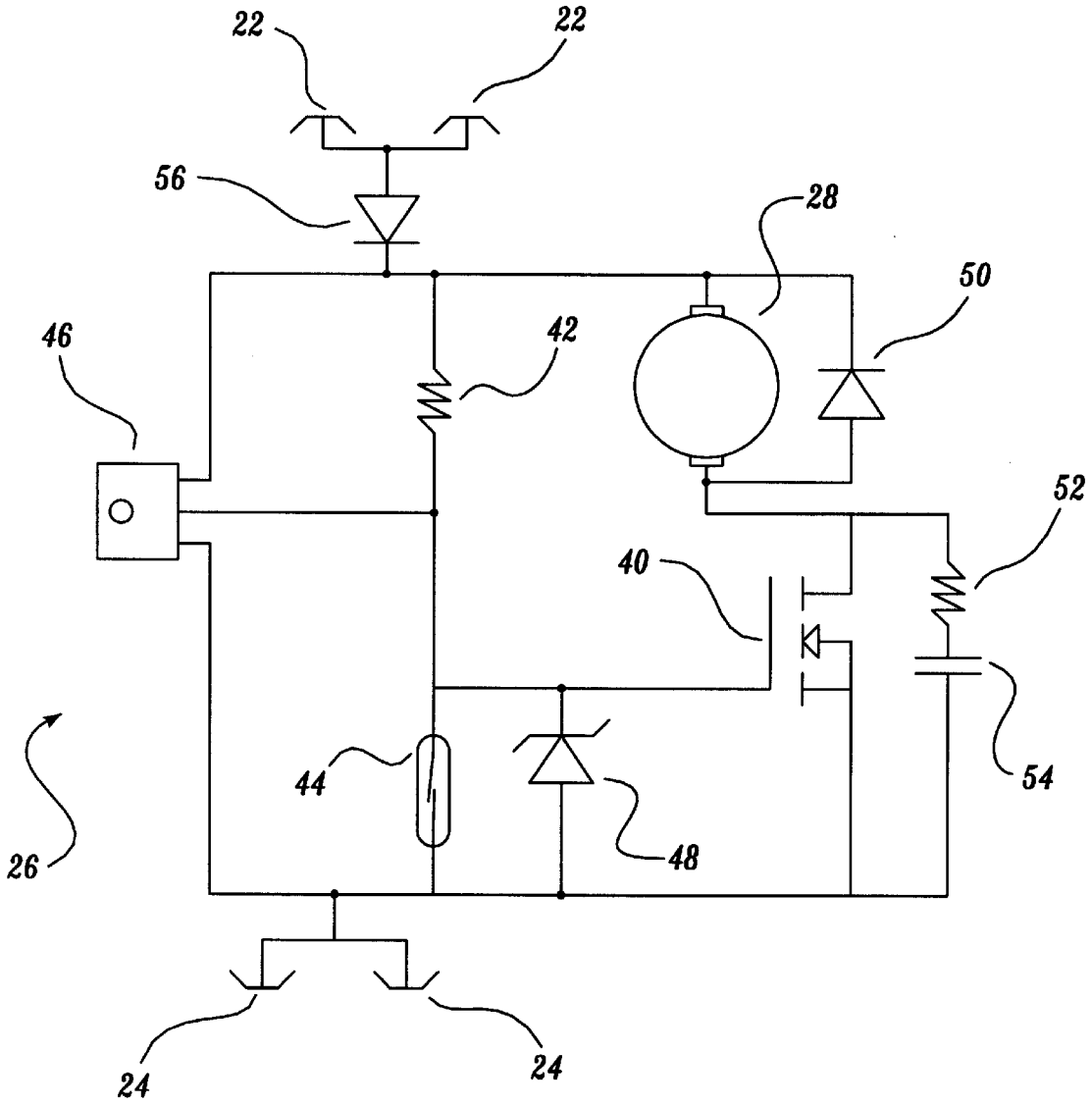
FIG. 8 is an electrical schematic of the control circuit of the subsurface vehicle employed with the present invention.
Figure 9:
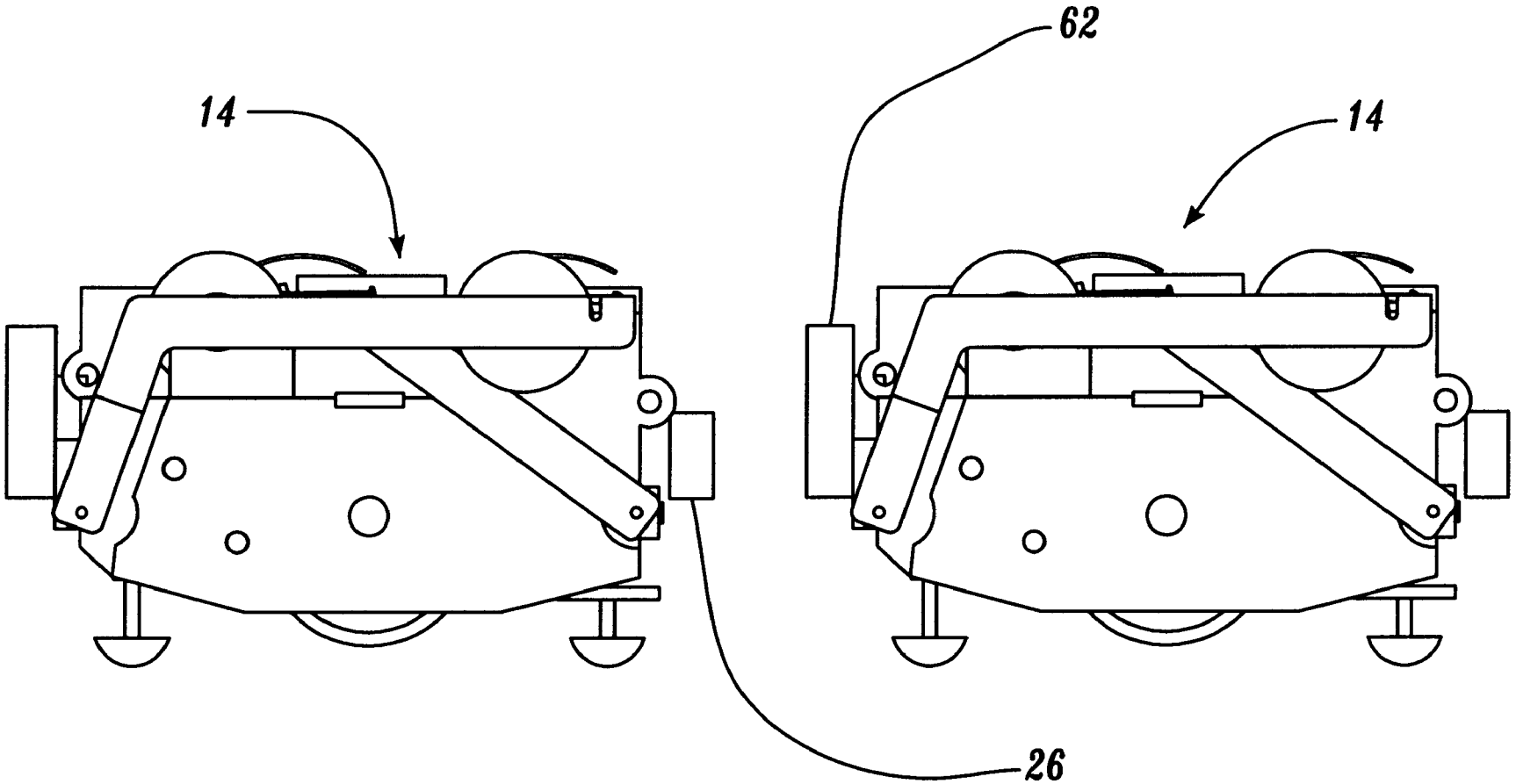
FIG. 9 is a diagrammatic elevation view of a leading subsurface vehicle and a following subsurface vehicle showing collision avoidance thereof.

Now referring to FIG. 8, control circuit 26 is described in further detail. Control circuit 26 is electrically connected to both upper brushes 22 and lower brushes 24. Control circuit 26 includes an FET 40 (for example, model No. ZVN4206A manufactured by Zetex) that is normally open because of 10k Ohm pull-up resistor 42. However, FET 40 deactivates electromotor 28 if a control or collision signal, for example either magnetic or optical, is detected by either reed switch 44 (for example, model No. MDSR-7 manufactured by Hamlin) or phototransistor 46 (for example, model no. QSE159 manufactured by QT Optoelectrics). Zener diode 48 (for example, model no. 1N5242 manufactured by Liteon Power Semiconductor) prevents overvoltage of the gate of FET 40. Diode 50 (for example, model no. 1N4448 manufactured by National Semiconductor), as well as an RC-chain consisting of 100 Ohm resistor 52 and 0.1 mcF capacitor 54, protect control circuit 26 from inductive spikes from electromotor 28. Diode 56 (for example, model no. IN4004 manufactured by Motorola) protects control circuit 26 from reverse polarity of power supply 16. More specifically phototransistor 46 detects infrared light from IR emitters located at intersections of toy building set 2 to stop subsurface vehicle 14 in a manner further described below. Reed switch 44 is employed in collision avoidance of two subsurface vehicles 14 based upon detection of a magnetic signal to cause FET 40 to deactivate electromotor 28. In particular, reed switch 44 of control circuit 26 is employed to prevent a rear end collision between a leading and a following subsurface vehicle 14. As shown in FIG. 9, control circuit 26 is preferably located on the front of following subsurface vehicle 14 so that control circuit 26 and its reed switch 44 (see FIG. 8) will be in close proximity to the magnetic field of rear magnet 62 of leading subsurface vehicle 14. When the following subsurface vehicle 14 closes to a predetermined distance, the magnetic field of rear magnet 62 of leading subsurface vehicle 14 is sensed by reed switch 44. Reed switch 44 causes FET 40 to deactivate electromotor 28, thus stopping the following subsurface vehicle 14. When the leading subsurface vehicle 14 moves away from the following subsurface vehicle 14, the increased distance therebetween removes the magnetic field of rear magnet 62 of leading subsurface vehicle 14 from proximity to reed switch 44 of following subsurface vehicle 14. FET 40 thus activates electromotor 28 for movement of following subsurface vehicle 14.

Figure 10:
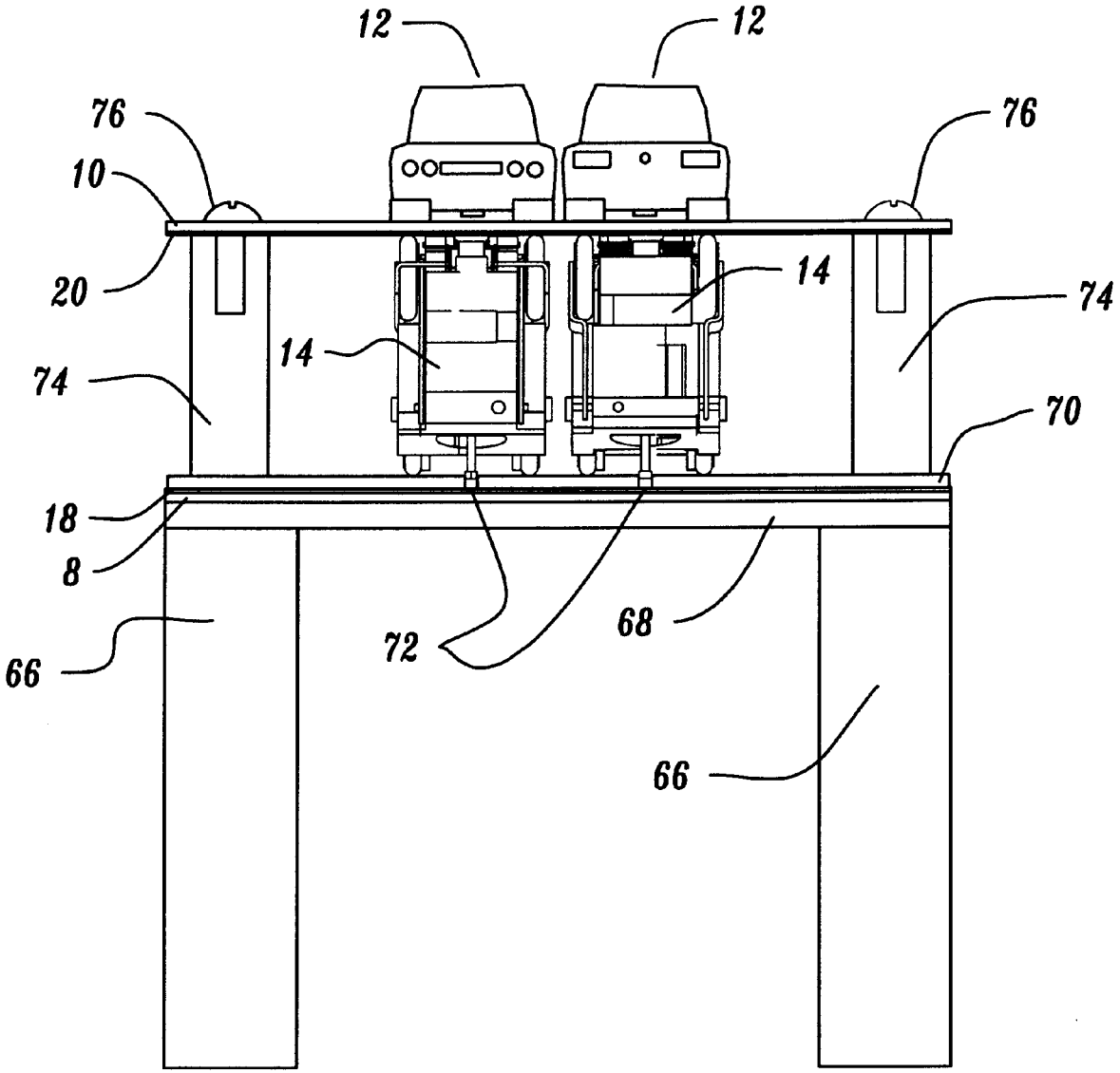
FIG. 10 is a transverse section view of the upper roadway, lower roadway, two surface vehicles and two powered subsurface vehicles employed with the present invention.
Figure 11:
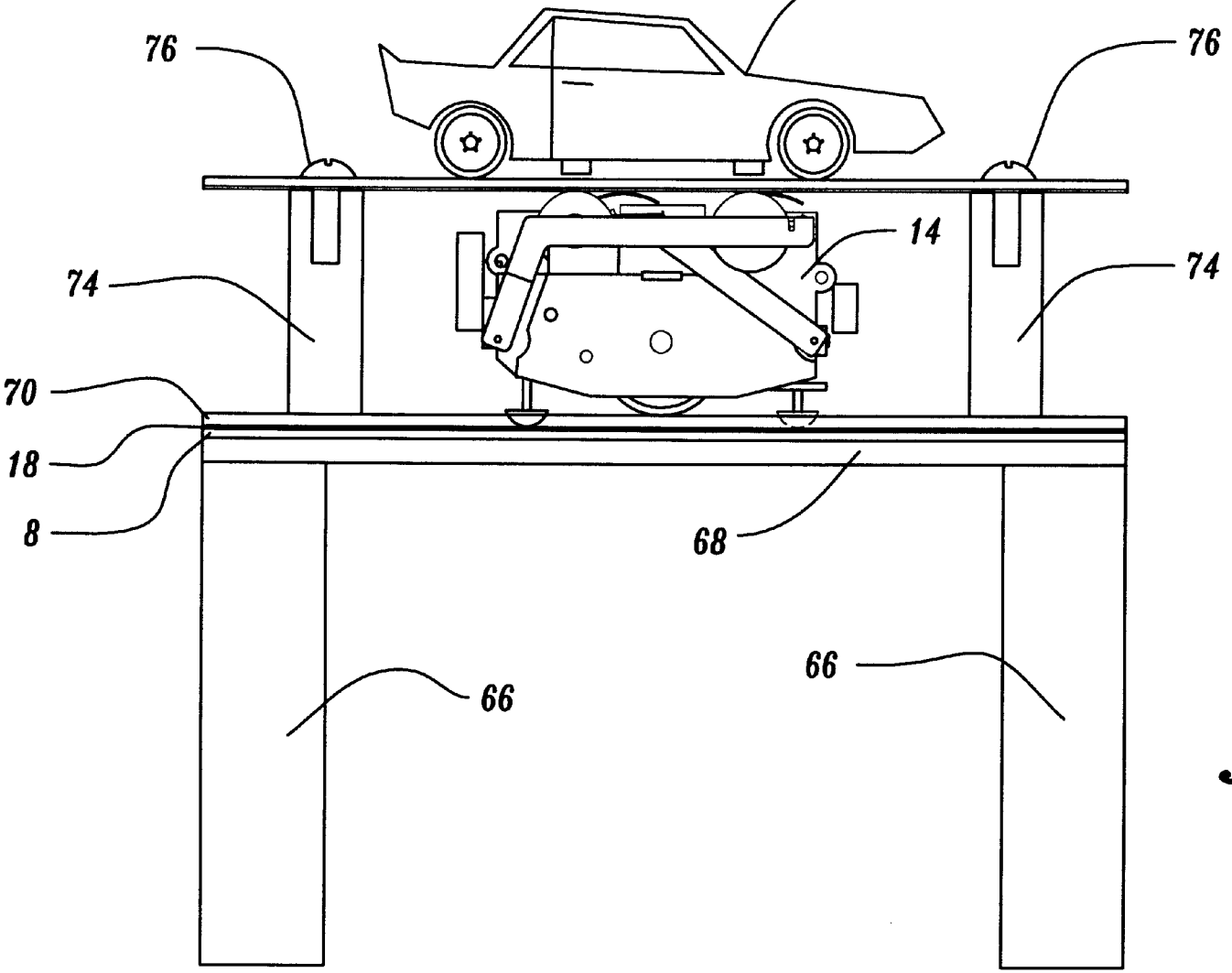
FIG. 11 is a diagrammatic side section view of the upper roadway, lower roadway, surface vehicle and powered subsurface vehicle employed with the present invention.
Figure 12:
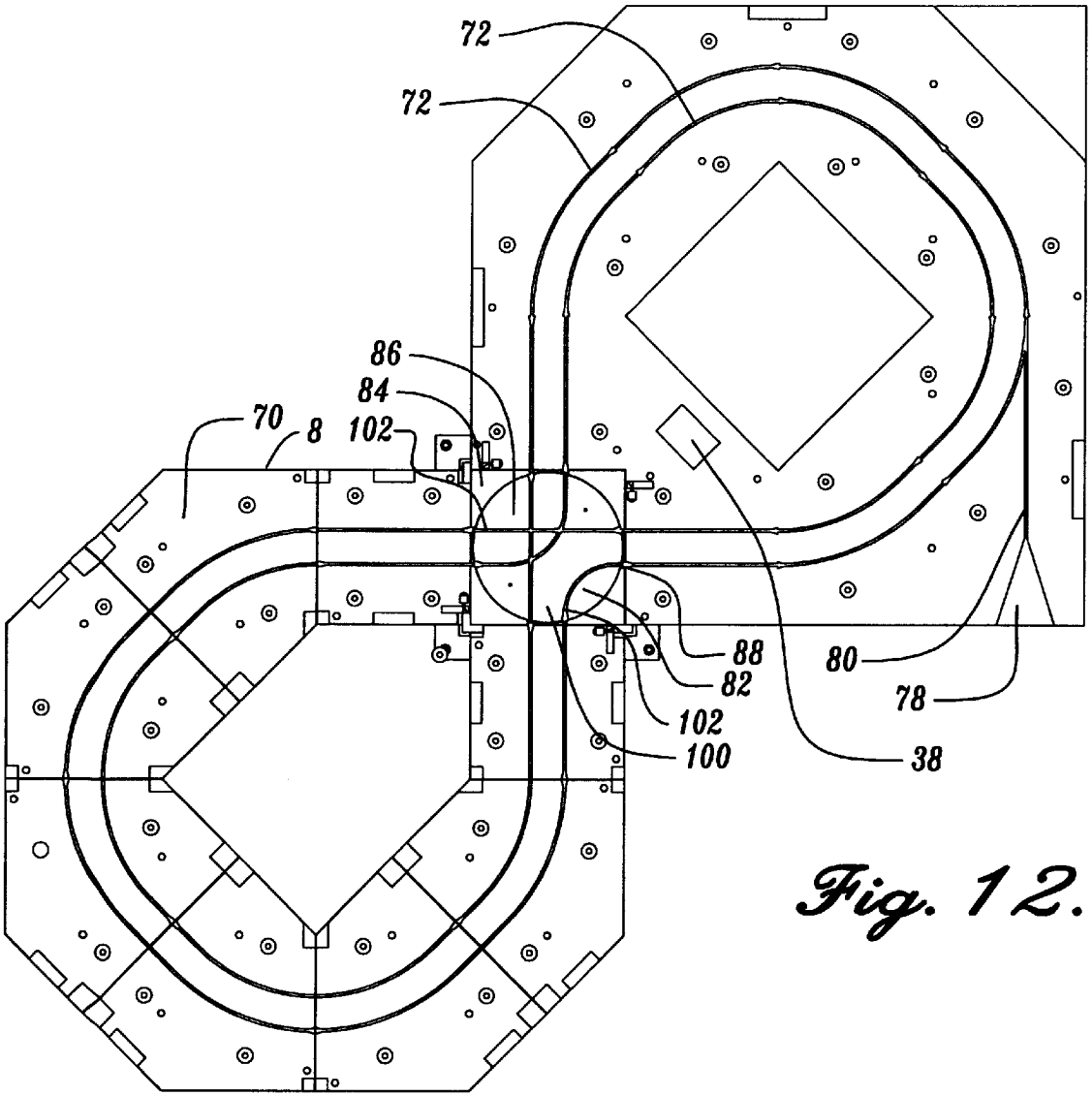
FIG. 12 is a plan view of the lower roadway employed with the present invention with an intersection turntable.

Next referring to FIGS. 10 and 11, further structural detail of one embodiment of lower roadway 8 and upper roadway 10, between which subsurface vehicle 14 travels, is shown. Lower vertical supports 66 are aligned in two spaced apart sets to support horizontal plate 68, which is preferably comprised of aluminum or other metal alloy. Horizontal plate 68 is the foundation for lower roadway 8, which is preferably comprised of ABS. As stated above, lower conductive layer 18, comprised of copper or other conductive material, is located on lower roadway 8. Sheet 70 is located over lower conductive layer 18 and is preferably comprised of non-conductive material, such as plastic or the like. Preferably, a plurality of grooves 72 are located in sheet 70. Grooves 72 are of a sufficient depth to expose the ;underlying lower conductive layer 18. As stated above, shoes 60 of lower brushes have a thickness sized to fit within grooves 72. In this manner, lower brushes 24 are in electrical communication with lower conductive layer 18. Additionally, grooves 72 guide subsurface vehicle 14 along a predefined route by the location of shoe 60 of lower brushes 24 in grooves 72. As best shown in FIG. 12, grooves 72 may be, for example, figure-8 in shape, or in any other desired shape, for controlled locomotion of subsurface routes. Still referring to FIG. 12, a separate groove 72 can be employed for each of a desired number of different routes for subsurface vehicles 14. Referring back to FIGS. 10 and 11, upper vertical supports 74 are fixedly attached to sheet 70 and are preferably spaced apart in two sets. On the upper ends of upper vertical supports 74 is upper roadway 10, having upper conductive layer 20 on its underside. Bolts 76 are employed to removably secure upper roadway 10 and upper conductive layer 20 to upper vertical supports 74. Upper vertical supports 74 preferably have a height precisely defined to allow electrical communication between lower brushes 24 of subsurface vehicle 14 and lower conductive layer 18, as well as between upper brushes 22 of subsurface vehicle 14 and upper conductive layer 20. Next referring to FIG. 12, entryway 78 is shown. Entryway 78 is preferably a triangular shaped indentation in lower roadway 8 with a groove 80 intersecting the apex of entryway 78 at one end of groove 80. Groove 80 is connected, at its other end, to one of grooves 72. Entryway 78 thus provides a convenient mode of ingress for subsurface vehicle 14 between lower roadway 8 and upper roadway 10.

Figure 13:
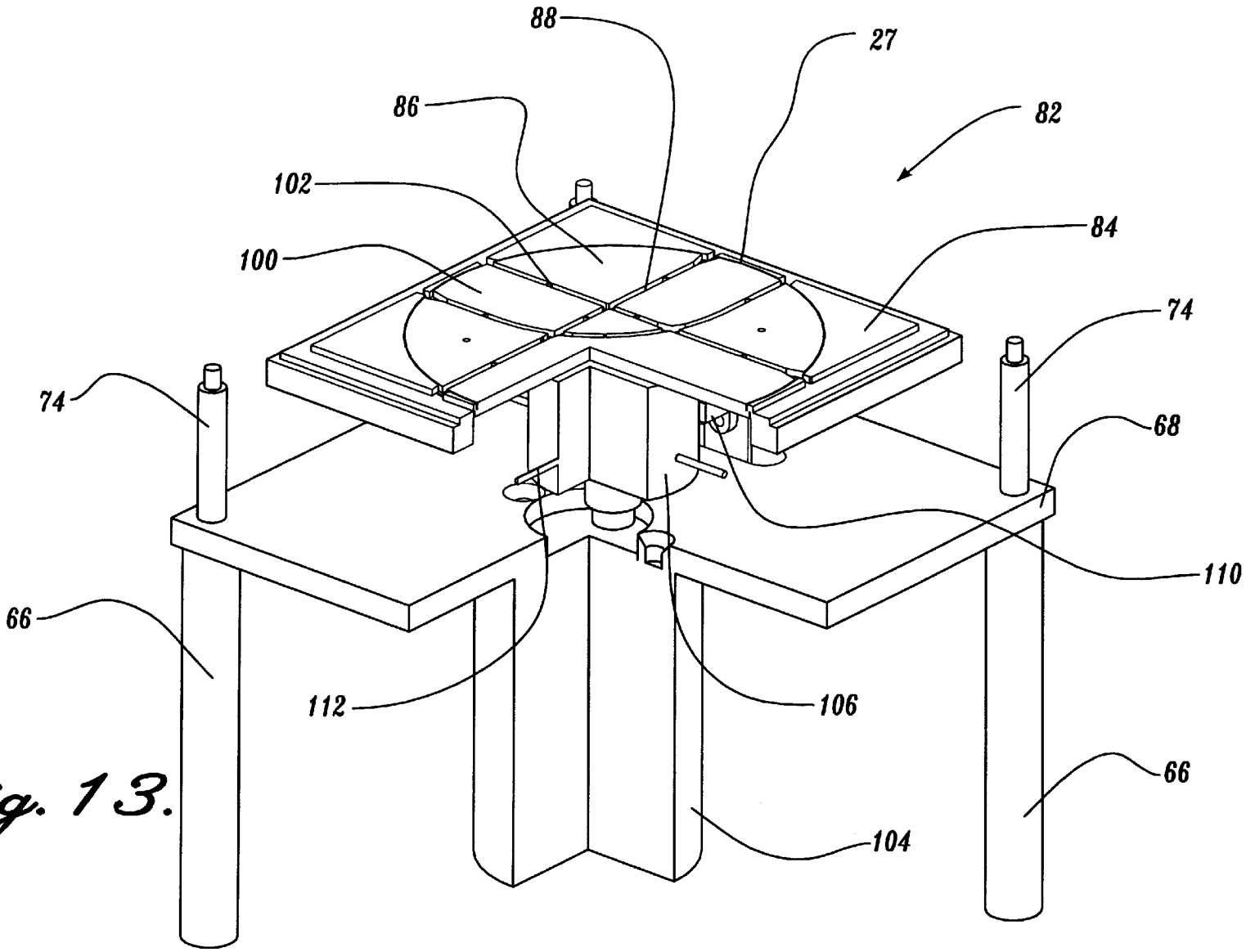
FIG. 13 is an isometric partially exposed view of the intersection turntable of FIG. 12.

Referring to FIGS. 12 and 13, intersection turntable 82 is shown. Preferably, more than one intersection is present, with an intersection turntable 82 for each intersection. Intersection turntable 82 is rotatable with respect to lower roadway 8 and controls the passage of subsurface vehicle 14, and thus surface vehicle 12, at intersections of lower roadway 8 and upper roadway 10. More specifically, axial rotation of intersection turntable 82 determines whether a specific subsurface vehicle 14 and surface vehicle 12 pass straight through a given intersection, turn left, or turn right. Intersection turntable 82 includes a first planar member 84 and a second planar member 86. First planar member 84 is fixed with respect to lower roadway 8, while second planar member 86, centrally located in first planar member 84, is preferably circular in shape and is axially rotatable with respect to first planar member 84 and lower roadway 8. Second planar member 86 includes a lower conductive layer 88 inplane with lower conductive layer 18 of lower roadway 8. Additionally, second planar member 86 has a non-conductive, preferably plastic, sheet 100 on lower conductive layer 88 that is inplane with sheet 70 on lower conductive layer 18 of lower roadway 8. Grooves 102 expose lower conductive layer 88 to contact lower brushes 24 of subsurface vehicle 14 in the same manner as do grooves 72 of sheet 70. As best shown in FIG. 12, grooves 102 are oriented and aligned on second planar member 86 such that, when second planar member 86 is rotated in 90 degree increments, for example, each of grooves 102 will mate with one of grooves 72 for passage of a subsurface vehicle 14 across second planar member 86. The configuration of grooves 102, and the rotational orientation of second planar member 86 in one of four possible configurations (in the embodiment of FIG. 12), dictates whether subsurface vehicle, and magnetically interconnected surface vehicle 12, passes straight through an intersection, turns left or turns right. However, while grooves 102 are configured to physically align with different grooves 72 depending on the rotational orientation of second planar member 86 of intersection turntable 82, lower conductive layer 88 of intersection turntable 82 is preferably not in electrical communication with lower conductive layer 18 of lower roadway 8. Instead, lower conductive layer 88 of intersection turntable 82 is separately electrically connected to a different terminal of the electrical circuitry of the guidance control of intersection turntable 82 than is lower conductive layer 18, as shown in detail in FIG. 16. As described further below, this separate electric connection of lower conductive layer 88 facilitates, in part, traffic control through intersection turntable 82 based on sensing of current level in lower conductive layer 88. Regarding traffic movement through intersection turntable 82, referring to FIG. 13, relative axial rotation of second planar member 86 with respect to first planar member 84 is facilitated by geared DC motor 104 that is connected to the underside of rotatable second planar member 86 by shaft 106. Preferably, geared DC motor 104 is located under horizontal plate 68, and shaft 106 passes through an opening in horizontal plate 68 such that second planar member 86 and first planar member 84 are supported on horizontal plate 68 inplane with lower roadway 8, lower conductive layer 18 and sheet 70. Horizontal plate 68 is supported by lower vertical supports 66, as described above. Geared DC motor 104 can be rotated randomly and periodically by preprogramming such that subsurface vehicles 14 and their associated surface vehicles 12 can randomly pass straight through an intersection, turn left, or turn right, depending upon when the subsurface vehicle 14 and associated vehicle 12 enter the intersection. Additionally, directional control of subsurface vehicle 14 and an associated surface vehicle 12 can be user initiated by activation of geared DC motor 104 at a predetermined time to rotate second planar member 86 a predetermined amount to facilitate the desired change in direction of subsurface vehicle 14 and associated surface vehicle 12. Both of these options are discussed in further detail below. In order to ensure that rotatable second planar member 86 is configured in one of four, for example, possible configurations as it is rotated in 90° increments, four optical sensors 110, preferably a small aperture sensor, for example, model No. OPB890 manufactured by Optex Technologies, are located on intersection turntable 82 at a position stationary with respect to rotatable second planar member 86 and configured such that each of the apertures of the four optical sensors 110 is oriented 90° with respect to two of the other apertures of two of the other optical sensors 110, and 180° from the aperture of the fourth optical sensor 110. Four flags 112 are located on shaft 106 that rotates second planar member 86. The four flags 112 are configured at 90° increments and are alignable with the four apertures of the four optical sensors 110 as second planar member 86 is rotated. When one or more of flags 112 intersects the "line of sight" of one or more of the apertures of optical sensors 110, power to geared DC motor 104 is terminated to ensure that second planar member 86 has rotated precisely 90° so that grooves 102 thereon are precisely aligned with grooves 72 for passage of subsurface vehicle 14 across intersection turntable 82.

Figure 14:
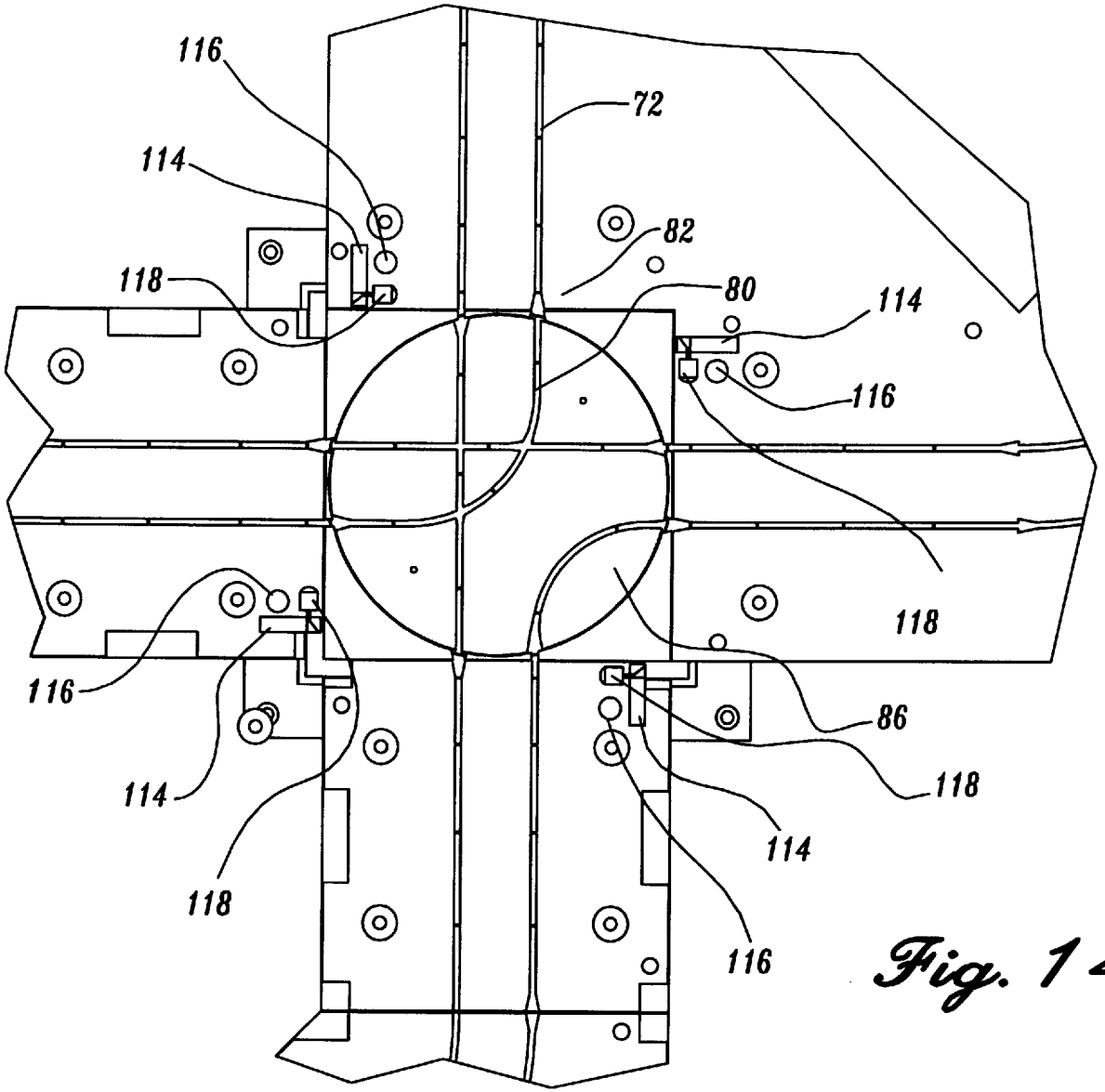
FIG. 14 is a detail plan view of FIG. 12 showing the electric guidance elements of the intersection turntable employed with the present invention.
Figure 15:
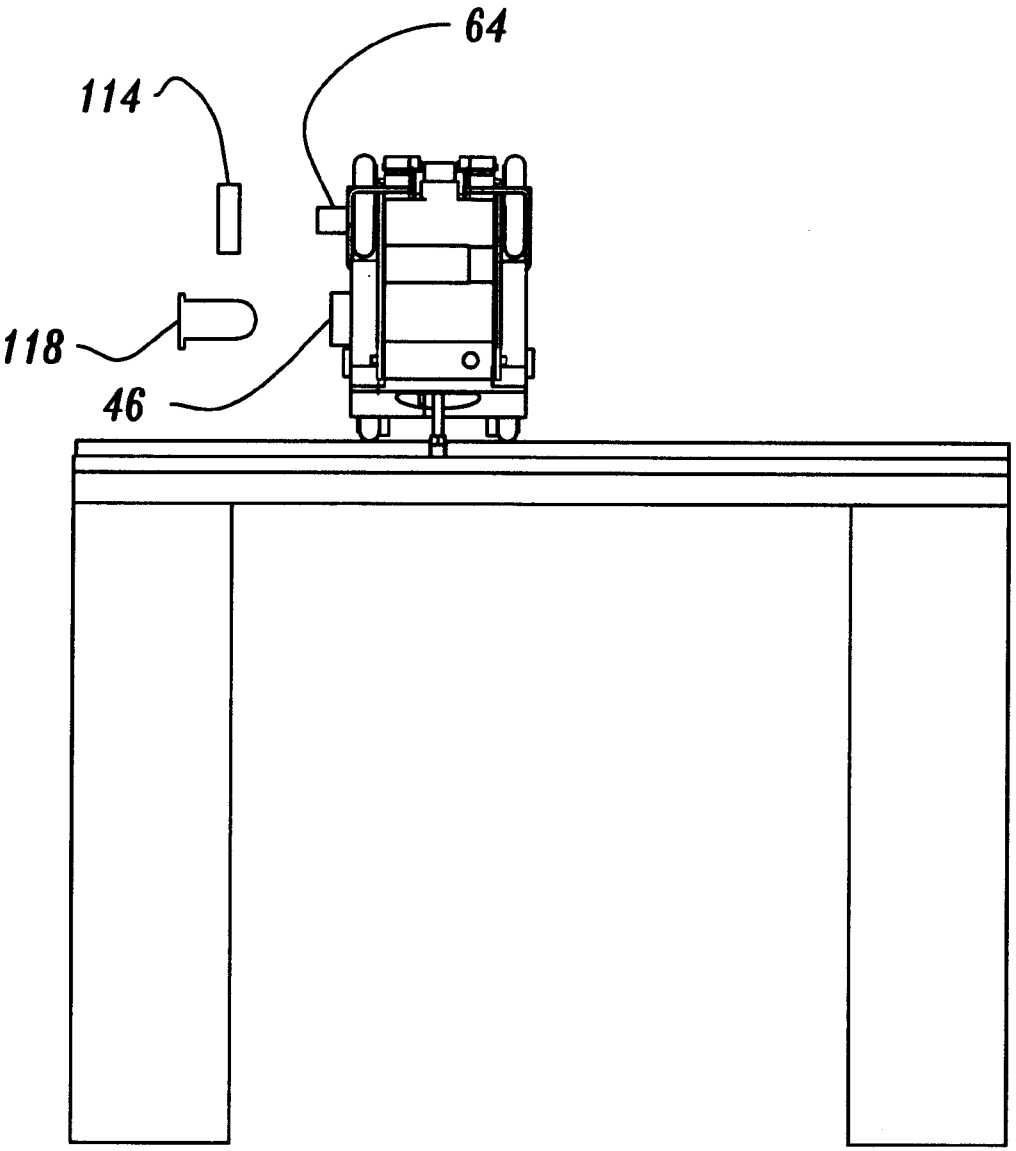
FIG. 15 is a diagrammatic section view of the interaction between the guidance control elements located adjacent the intersection turntable and on the subsurface vehicle employed with the present invention.
Figure 16:
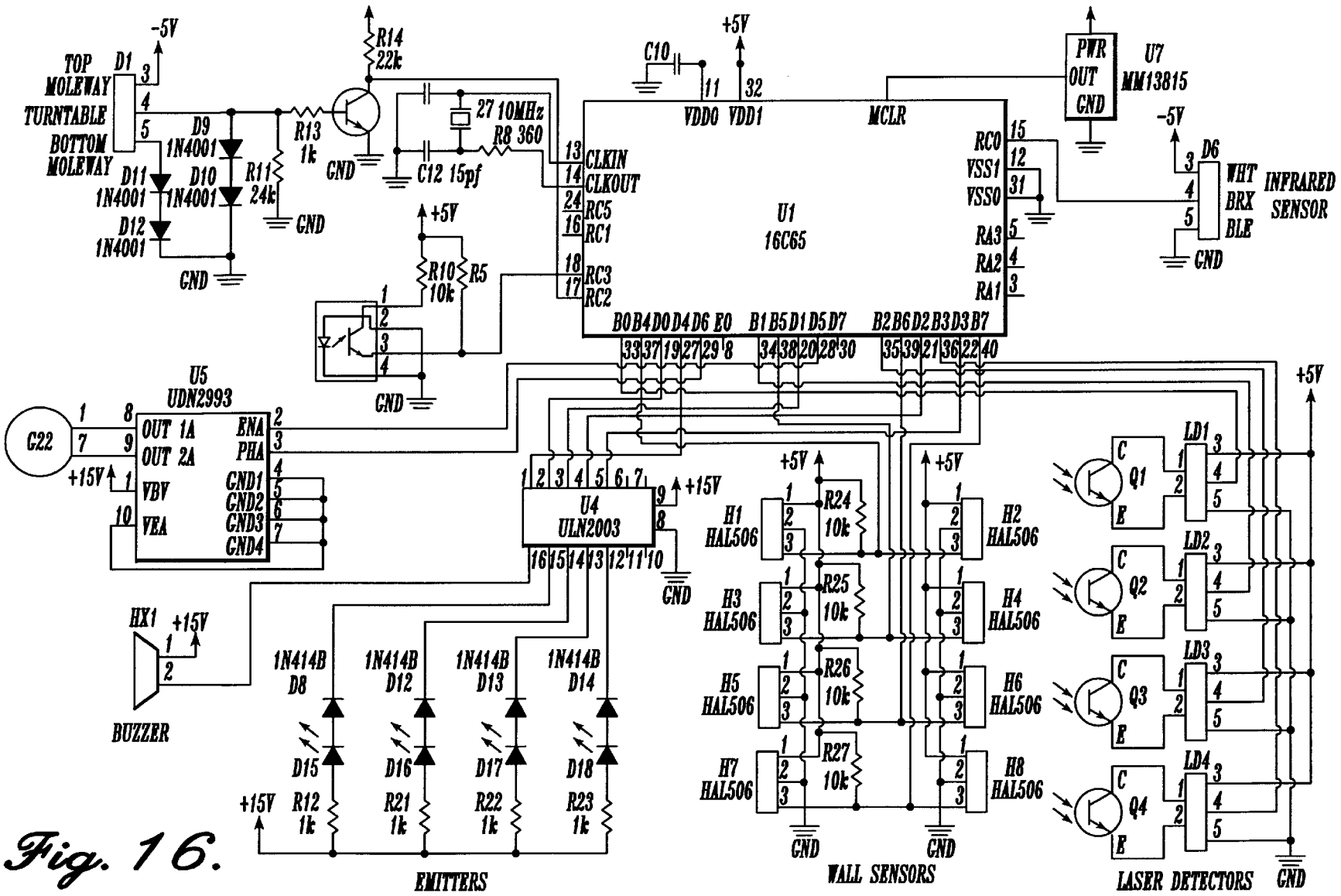
FIG. 16 is an electrical schematic of the guidance control of the intersection turntable of FIG. 12 specifically showing the laser detectors and infrared sensor of the present invention.

Referring to FIGS. 14–16, the guidance control elements located adjacent to intersection turntable 82 and on subsurface vehicle 14 are described. As shown in FIGS. 14 and 15, Hall effect sensors 114 (for example, model No. HAL506 manufactured by ITT Semiconductors) are located adjacent each groove 72 leading to intersection turntable 82. As shown in FIG. 15. Hall effect sensors are aligned to sense the magnetic field of side magnet 64 of subsurface vehicle 14 as subsurface vehicle 14 approaches intersection turntable 82.

As will be described in further detail below in regard to FIG. 16, when the magnetic field of side magnet 64 is detected by a Hall effect sensor 114 in the random operation mode previously mentioned above, geared DC motor 104 is energized to randomly rotate second planar member 86 a predetermined amount prior to entry of subsurface vehicle 14 onto second planar member 86. In this manner, random control of the direction of subsurface vehicle 14, and the associated surface vehicle 12, is attained at intersection turntable 82.

In the user controlled intersection turntable configuration, laser detectors 116 can be located on upper roadway 10 adjacent each groove 72 on which subsurface vehicle 14 can enter intersection turntable 82. Laser detectors 116 receive commands from remote control devices that are user operable to rotate second planar member 86 of intersection turntable 82 the amount necessary to cause subsurface vehicle 14 and associated surface vehicle 12 to pass straight through, turn left, or turn right at the intersection. Instructions received from the hand-held remote control can be verified by a buzzer, light, or other audible or visual signaling device. In the user controlled mode of intersection turntable 82, the Hall effect sensor interaction between side magnet 64 of subsurface vehicle 14 and Hall effect sensor 114 releases intersection turntable rotation commands stored in the electrical circuitry (micro controller U1) of FIG. 16 to facilitate predefined rotation of intersection turntable 82.

In either the random configuration mode or the user-controlled configuration mode of intersection turntable 82, subsurface vehicle 14 and its associated surface vehicle 12 may pause prior to entering intersection turntable 82 so that second planar member 86 of intersection turntable 82 can be rotated, either randomly or under user control, to its modified orientation. Thus, infrared emitters 118 are located adjacent each groove 72 on which a subsurface vehicle 14 can enter intersection turntable 82. Infrared emitters are oriented to trigger phototransistor 46 on the side of subsurface vehicle 14, as shown in FIG. 15. As shown in FIG. 8, when the infrared transmission of infrared emitter 118 is detected by phototransistor 46 of control circuit 26, electromotor 28 is deactivated by FET 40, thus stopping subsurface vehicle 14. Infrared emitter 118 is illuminated until second planar member 86 of intersection turntable 82 has been rotated to its desired configuration. Infrared emitter 118 is then deenergized, thus terminating the signal from phototransistor 46 that causes FET 40 of control circuit 26 to deactivate electromotor 28; electromotor 28 is thus reactivated and subsurface vehicle 14 continues onto intersection turntable 82. Note that all infrared emitters 118 at an intersection are illuminated for a predetermined time period after a subsurface vehicle 14 passes onto intersection turntable 82 in order to prevent other subsurface vehicles 14 from traveling onto intersection turntable 82. After the predetermined time has passed, one of the infrared emitters 118 is deenergized, and another subsurface vehicle 14 can enter intersection turntable 82. Alternatively, the activation and deactivation of infrared emitters 118 can be controlled by a current sensor (transistor Q5 of FIG. 16) which determines whether another subsurface vehicle 14 is already on intersection turntable 82 by sensing whether current is presently supplied to lower conductive layer 88 of intersection turntable 82 to propel the subsurface vehicle 14 through intersection turntable 82. If transistor Q5 of FIG. 16 senses current in lower conductive layer 88, indicating a subsurface vehicle 14 is passing across intersection turntable 82, infrared emitters 118 are energized to prevent other subsurface vehicles 14 from entering intersection turntable 82. If transistor Q5 does not sense current in lower conductive layer 88, no subsurface vehicles 14 are passing across intersection turntable 82 and infrared emitters are de-energized so that a subsurface vehicle 14 is not stopped prior to entering intersection turntable 82.

Next referring to FIG. 16, the electrical circuitry of the guidance control of intersection turntable 82 is described. All logic functions are performed by an eight-bit microcontroller U1 (for example, model No. PIC16C65, manufactured by Microchip). Microcontroller U1 is clocked by a 10 MH quartz crystal, model No. A143E manufactured by International Quartz Devices. Voltage monitor U7, for example, model No. 1381S manufactured by Panasonic, is responsible for the power-up reset and power supply fault protection. When the logic supply voltage (plus 5V) drops below 4.2V, the voltage detector drives LOW the MCLR pin of microcontroller U1, thus shutting it down to prevent it from operation at reduced power supply voltage. When the logic supply voltage (plus 5V) is above 4.2V, the voltage detector drives HIGH the MCLR pin of microprocessor U1, thus resetting it and reinitializing the system. Full bridge driver U5, for example, model No. UDN2993, manufactured by Allegro, drives geared DC motor 104, for example, model No. 127P727 manufactured by Barber-Colman Company, of intersection turntable 82. When pin ENA of driver U5 is HIGH, the state of pin PHA determines polarity of the voltage applied to geared DC motor 104, and thus the direction of motor rotation. When pin ENA of full bridge driver U5 is LOW, geared DC motor 104 is not energized regardless of the state of pin PHA. Infrared emitters 118 are designated as D15–D18 and are, for example, model No. QED123, manufactured by QT Optoelectrics. Infrared emitters D15–D18 are driven through Darlington array U4, for example, model No. ULN2003, manufactured by Motorola. When powered, infrared emitters D15–D18 emit beams of infrared radiation. As stated above, if the infrared radiation reaches phototransistor 46 of subsurface vehicle 14, subsurface vehicle 14 will stop. Another channel of Darlington array U4 drives a buzzer or other sound device HN1, for example, model No. P9948 manufactured by Panasonic that provides user feedback for the hand-held remote control device. Hall effect sensors 114, described above, are designated H1-H8 and are, for example, model No. HAL506 manufactured by ITT Semiconductors. Hall sensors H1–H8 are paralleled in pairs to enlarge the sensitivity zone. When activated by side magnet 64 of a subsurface vehicle 14, Hall effects sensors H1–H8 drive LOW inputs RB4–RB8 of microcontroller U1, thus denoting that a subsurface vehicle 14 has entered intersection turntable 82. Since Hall effect sensors H1–H8 are open collector outputs, pull-up resistors R24–R27 are necessary to drive inputs of microprocessor U1 HIGH when no subsurface vehicle 14 is detected. Laser detectors 116, described above, are denoted as LD1–LD4 and are connected directly to inputs of microprocessor U1 to provide input as to the desired rotation of second planar member 86 of intersection turntable 82. The active level of laser detectors LD1–LD4 is HIGH. Infrared sensor U6, for example, model No. TFM5300 manufactured by Temic, selects the route of subsurface vehicle 14 via the interface of the remote control. The information pertaining to the desired direction of subsurface vehicle 14 from the remote control interface is transmitted serially to microprocessor U1 and is then decoded. The current sensor that sense when a subsurface vehicle 14 is on intersection turntable 82 is based on transistor Q5, which drives LOW the RC2 input of microcontroller U1 when a subsurface vehicle 14 is on intersection turntable 82; power supply current thus flows from subsurface vehicle 14 through diodes D9 and D10 to bias transistor Q5. When no subsurface vehicle 14 is on intersection turntable 82, the current flows through lower conductive layer 18 of lower roadway 8 and through diodes D11 and D19. Transistor Q5 is closed because there is no bias current, and RC2 is driven HIGH by pull-up resistor R14. The above circuit requires three power supply voltages: +5V, +15V, and the voltage of the subsurface vehicle 14 that is adjustable between +5V and +12V.

Figure 17A:
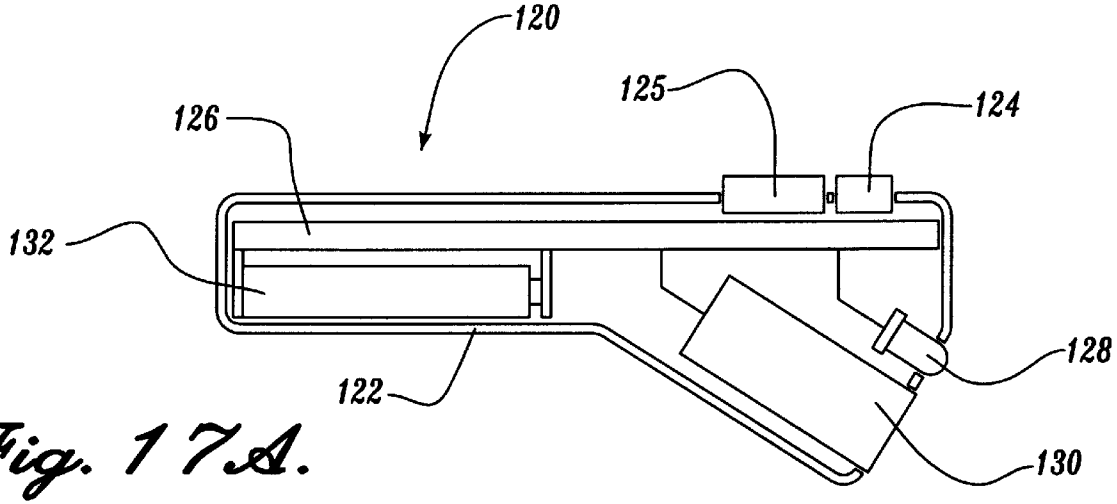
FIG. 17A is a section through the hand unit of the optoelectric remote control apparatus of the present invention.
Figure 17B:
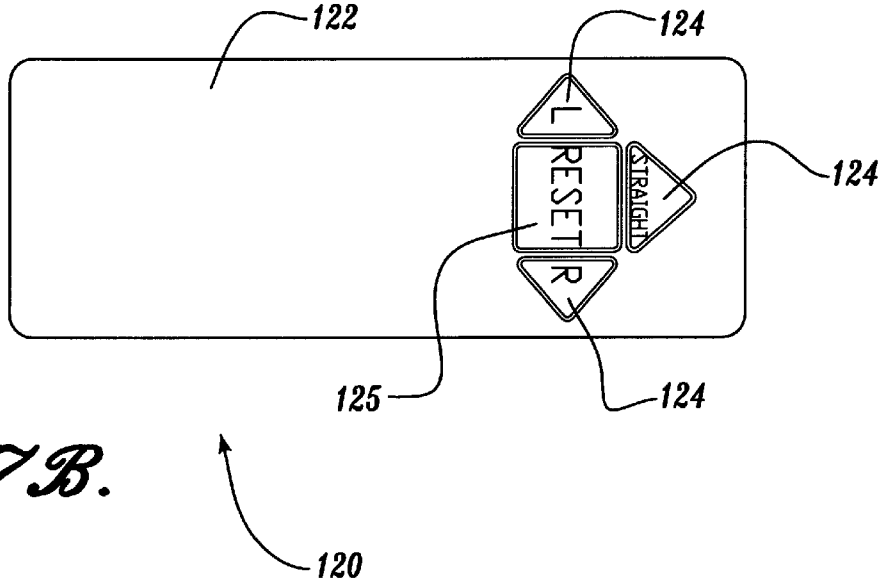
FIG. 17B is a plan view of the hand unit of the optoelectric remote control apparatus of the present invention.

Referring to FIGS. 17A–20, the optoelectric remote control apparatus of the present invention is described in detail. Referring specifically to FIGS. 17A and 17B, hand unit 120 includes case 122, that is preferably comprised of a plastic or other synthetic polymer. Case 122 has a plurality of direction keys 124 and a reset key 125 protruding through the upper surface thereof. Direction keys 124 and reset key 125 transmits signals from hand unit 120 in a manner further described below. Case 122 holds circuit board 126 that has thereon electric circuitry, further described below, that allows vehicle control by the use of hand unit 120. Case 122 also houses infrared LED 128 and laser transmitter 130. While infrared LED 128 is shown, any nondirectional coded control signal can be employed. While laser transmitter 130 is shown, any directional light source can be employed. Both infrared LED 128 and laser transmitter 130 are electronically interconnected with circuit board 126. Additionally, both infrared LED 128 and laser transmitter 130 have optical transmission elements that protrude out of the front of hand unit 120 for transmission of infrared and laser signals. Power source 132 is also contained within case 122 and provides electrical power to circuit board 126, infrared LED 128 and laser transmitter 130. Power source 132 is preferably comprised of batteries such as, for example, 2 AA size batteries. Hand unit 120 transmits one of four, for example, commands, i.e., left, right, straight, or reset, via a 2-stage frequency modulated infrared signal that is received by infrared sensor U6 of FIG. 16, infrared sensor U6 preferably being associated with microprocessor U1 that controls one or more intersection turntables 82, as described above. Additionally, hand unit 120 transmits a laser signal to one of many reception points, i.e., laser detectors 116. As stated above, a laser detector 116 is preferably located adjacent each road leading to an intersection turntable 82. More specifically, laser detector 116 can be located adjacent lower roadway 8 with an optical light conduit communicating laser detector 116 with upper roadway 10, or laser detector 116 itself can be located on upper roadway 10. Therefore, if a specific intersection 82 joins four roads, four separate laser detectors 116, one for each road, would be present. Thus, because the infrared signal generated by hand unit 120 that provides commands is omnidirectional, a single infrared sensor U6 usually can be present. As described above regarding FIG. 16, infrared sensor U6, which is preferably, for example, model No. TFM5300 manufactured by Temic, receives a command signal from hand unit 120, for example "right turn", and transmits this command to microprocessor U1 of FIG. 16. However, the laser signal from hand unit 120 is directionally specific, and when hand unit 120 is pointed at a specific one of laser detectors 116 associated with a specific road at a specific one of intersection turntables 82, this laser detector 116, and only this laser detector 116, is activated by the laser signal from hand unit 120. As stated above in regard to FIG. 16, the laser detector 116 that is so activated by the laser signal from hand unit 120 provides an input to microprocessor U1. Thus, microprocessor U1 of FIG. 16 is able to associate the control command received from infrared sensor U6 to a specific locale, i.e., specific intersection table 82 and roadway thereof, based upon which laser detector 116 was activated by the laser signal from hand unit 120. Microprocessor U1 of FIG. 16 will therefor apply the "right turn" command sent by the infrared signal of hand unit 120 to infrared sensor U6 to the specific locale with which the activated laser detector 116 is associated. The infrared signal generated by hand unit 120 is therefor a control signal and the laser signal of hand unit 120 is a location signal designating which locale of intersection table 82 is to be controlled. Infrared sensor U6 of FIG. 16 is internally preset for a 30 kHz carrier frequency and has a logic level output compatible with microprocessor U1.

Figure 18A:
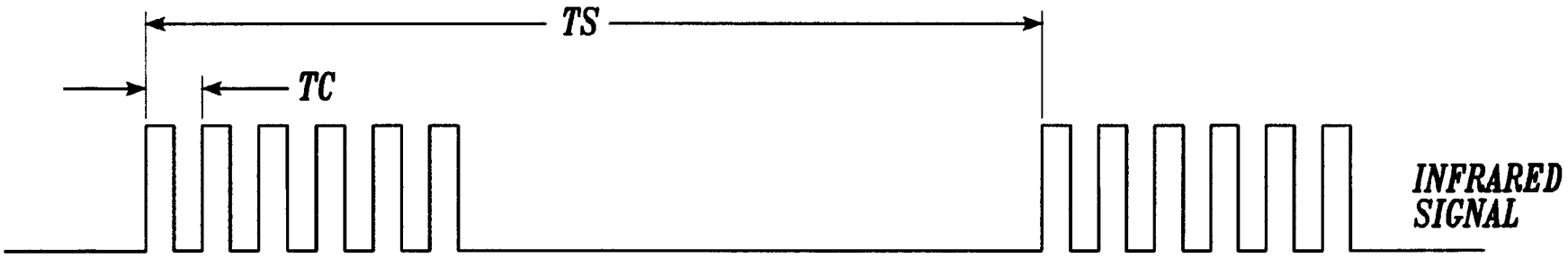
FIG. 18A is a graphical representation of the infrared signal transmission from the hand unit of the optoelectric remote control of the present invention.
Figure 18B:
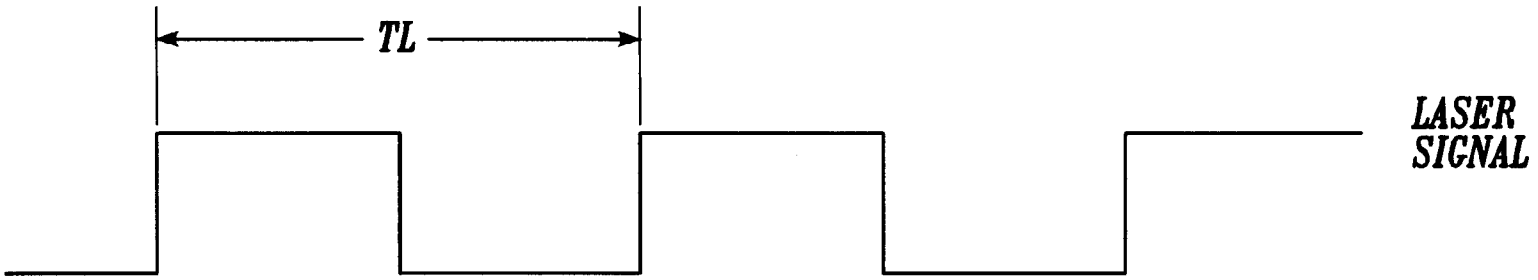
FIG. 18B is a graphical representation of the laser signal transmission from the hand unit of the optoelectric remote control of the present invention.

Referring to FIGS. 18A and 18B, the data transmission protocol of the infrared signal and the laser signal transmitted by hand unit 120 is now described. First referring to FIG. 18A, as stated above, the infrared data transmission employs two-stage frequency modulation. Infrared radiation with a carrier wave length of about 950 nm is modulated by an on/off carrier frequency of 30 kHz in order to insulate the command signals, i.e., left, right, straight, and reset, from ambient light and other sources of interference, shown as TC of FIG. 18A. The modulated infrared radiation can be further modulated by on/off signaling with four different frequencies, 0.4645, 0.316, 0.3097, and 0.2477 kHz, shown as TS on FIG. 18A. Each of the above four frequencies corresponds to one of the commands left, right, straight, and reset, respectively. Referring to FIG. 18B, the laser radiation of hand unit 120 is a 670 nm center wavelength visible light radiation. This laser radiation is also modulated by an on/off carrier frequency. The carrier frequency is 930 Hz, shown as TL on FIG. 18B. The carrier frequency allows the laser radiation to be distinguished from ambient light and other sources of interference.

Figure 19:
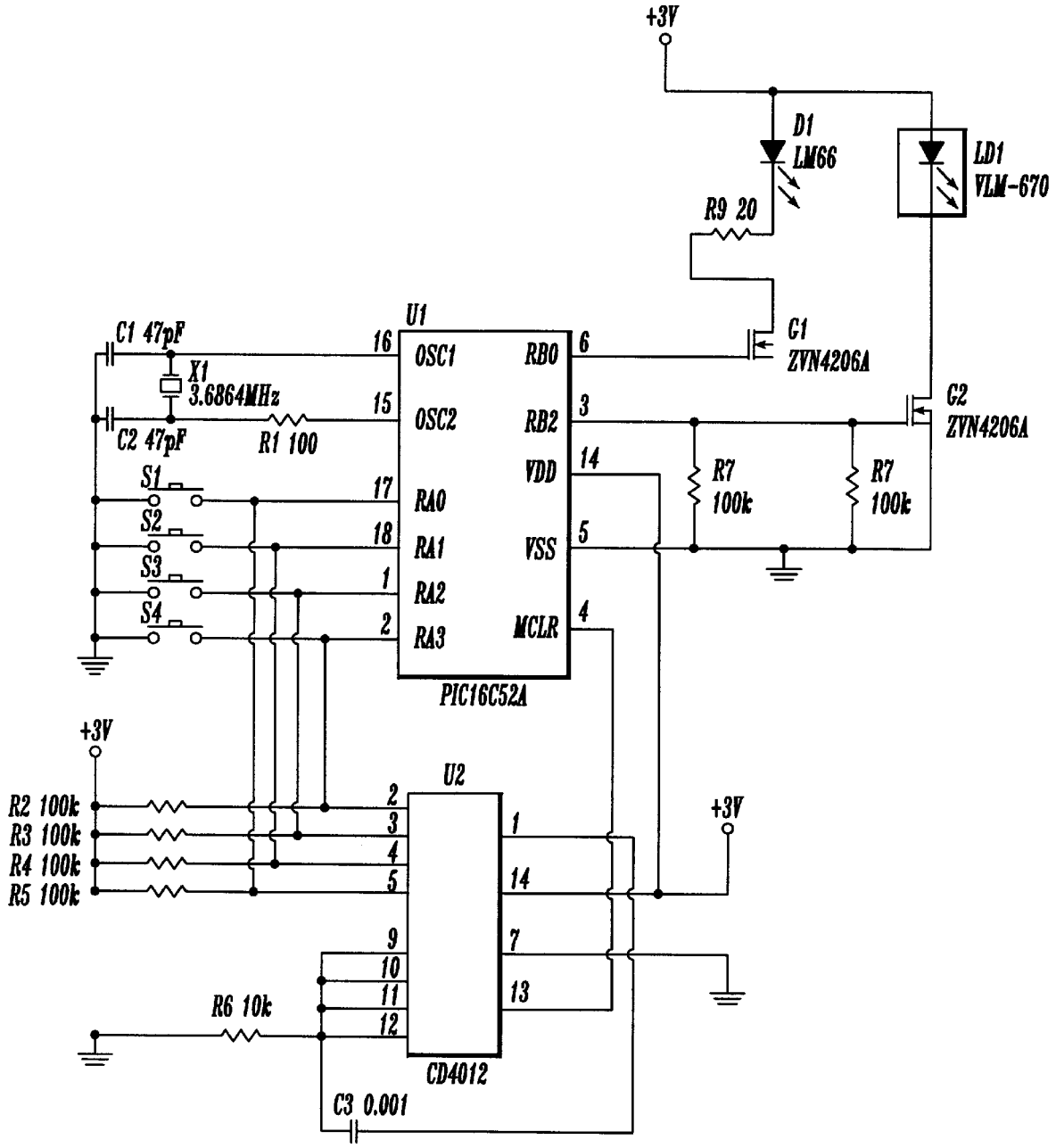
FIG. 19 is an electrical schematic of the circuitry of the hand unit of the optoelectric remote control hand apparatus of the present invention.

Next referring to FIG. 19, the electronic circuitry of control board 126 of hand unit 120 is described in detail. The control circuitry is based on an 8-bit microprocessor U1 which is preferably, for example, model No. PIC16C58, manufactured by Microchip. Microprocessor U1 has a software/hardware controllable "sleep" mode that provides oscillator shutdown and decreases the quiescent current of microprocessor U1 to less than 1 $\mu$A. Thus, microprocessor U1 is always powered, and no power switch is required for hand unit 120. To activate microprocessor U1 from its quiescent state, a short LOW pulse is applied to reset pin MCLR. A circuit based on dual 4NAND gates U2, , for example, model No. CD4012, manufactured by National Semiconductor, generates this short LOW pulse. Depression of any of direction keys 124 or reset key 125 will generate the above short positive pulse. However, when hand unit 120 is not in use and direction keys 124 and reset key 125 is not being depressed, all inputs of the first section of gate U2, pins 2, 3, 4, and 5, are pulled up by 100 k resistors R2, R3, R4, and R5, and the output of the first section of gate U2, pin 1, is LOW. However, inputs of the second section of gate U2, pins 9, 10, 11, and 12, are driven LOW by a common pull-down 10 k resistor R6, and the output of the second section of gate U2, pin 13, keeps HIGH the MCLR input of the microprocessor U1. In contrast, when any of the direction keys 124 or the reset key 125 is pressed, the appropriate input of gate U2 goes LOW and the output, pin 1, goes HIGH, thus generating a short positive pulse with a differentiator chain composed of 0.001 $\mu$F capacitor C3 and 10 k resistor R6. This pulse is inverted by the second section of gate U2 and is negative at the MCLR input of microprocessor U1, thus activating microprocessor U1 from its quiescent state. The microprocessor U1 then starts its internal oscillator, stabilized by a 3.6864 MHz quartz crystal X1, for example, model No. A16M, manufactured by International Quartz Devices. Microprocessor U1 then determines which control key 124 or reset 125 has been pressed by analyzing inputs RAO, RA1, RA2 and RA3. The input associated with the activated key is LOW, while all the other inputs associated with the other keys are driven HIGH by pull-up resistors R3, R4, and R5. If more than one of direction keys 124 and reset key 125 is pressed, priority is given to the input with the lowest number input, RAO-RA3. Microprocessor U1 then functions as a programmable frequency divider, providing pulse sequences as shown in FIGS. 18A and 18B. Signal period TS of FIG. 18A is selected for the one of direction keys 124 and reset keys 125 that had been pressed. The infrared pulse sequence is applied to the gate of FET Q1, for example, model No. ZVM4206A, manufactured by Zetex, via microprocessor U1 output RBO that results in infrared radiation being generated by infrared LED 128, designated D1 in FIG. 19. LED D1 is preferably, for example, model No. LM66 manufactured by Panasonic. Resistor R9, a 20 Ohm resistor, sets the LED current at approximately 60 milliA. The laser pulse sequence is applied to the gate of FET Q2, for example, model No. ZVM4206A, manufactured by Zetex, via microprocessor U1 output RB2, which causes laser transmitter 130, designated LD1 in FIG. 19, to generate visible laser radiation. No current limiting resistor is required for laser transmitter LD1. Each 70 microseconds, microprocessor U1 checks the status of direction keys 124 and reset key 125. If microprocessor U1 ascertains that the same key is still being pressed, it continues to generate the same pulse sequences. If microprocessor U1 ascertains that a different key is being pressed, microprocessor U1 changes the period TS of the infrared sequence to that of the new key being pressed. If microprocessor U1 determines that no key is currently being pressed, it enters the quiescent state.

Figure 20:
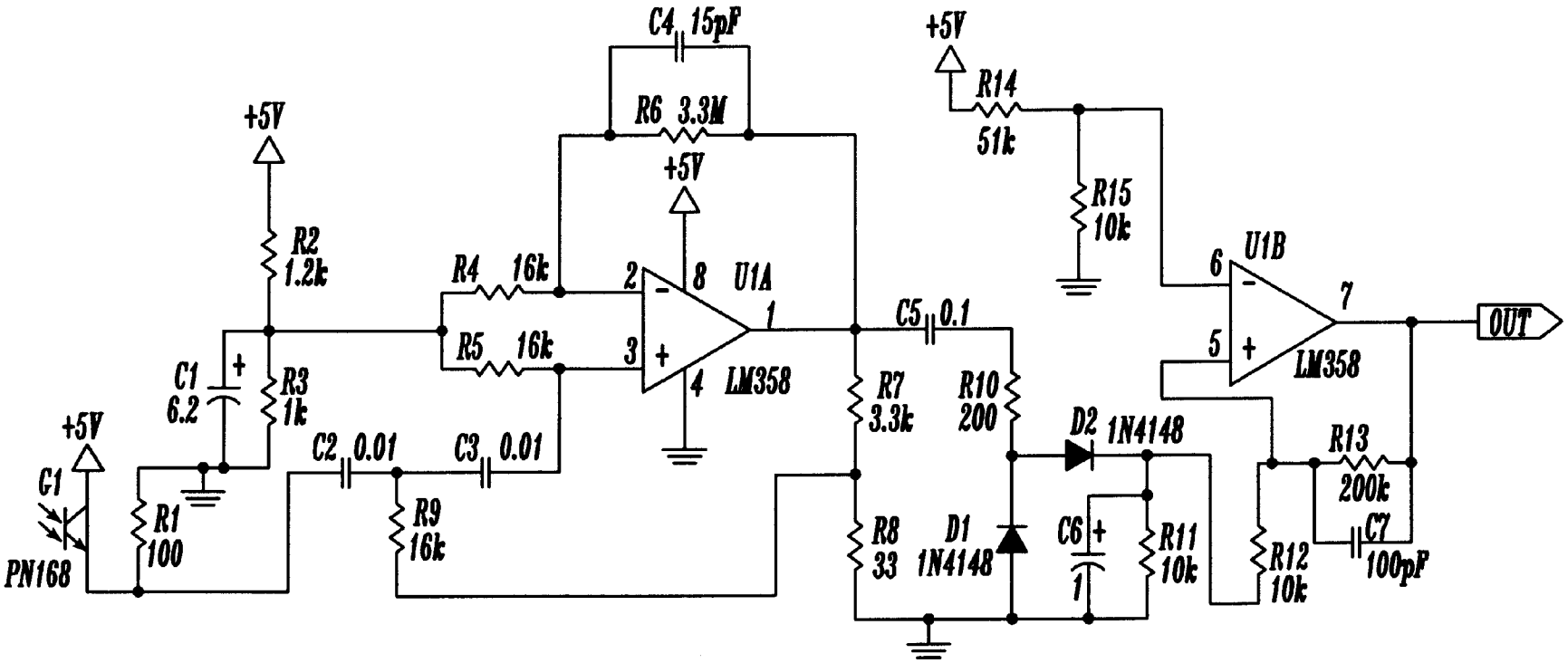
FIG. 20 is an electrical schematic of the circuitry of the laser detector of the optoelectric remote control apparatus of the present invention.

Next referring to FIG. 20, the electronic circuitry of laser detectors 116 is described. To distinguish the 930 Hz modulated red laser radiation of hand unit 120 from interfering background radiation, a specific circuitry configuration has been employed. Photo transistor Q1, for example, model No. PN168, manufactured by Panasonic, changes its current proportional to the radiation level, thus creating an additional voltage drop across resistor R1, a 100 Ohm resistor. This voltage is applied to the input of frequency sensitive operational amplifier U1A, for example, model No. LM358, manufactured by National Semiconductor. A voltage divider, consisting of resistor R2, a 1.2 k Ohm resistor, and resistor R3, a 1 k Ohm resistor, provides a DC bias to operational amplifier U1A. Resistor R6, a 3.3 M ohm resistor, and resistor R4, a 16 k Ohm resistor, set the DC gain of operational amplifier U1A to approximately 200. Capacitor C2, a 0.01 $\mu$F capacitor, capacitor C3, a 0.01 $\mu$F capacitor, resistor R5, a 60 k Ohm resistor, resistor R9, a 16 k Ohm resistor, and a voltage divider comprised of resistor R7, a 3.3 k Ohm resistor, and resistor R8, a 33 Ohm resistor, compose a Sallen-Key high pass filter with a cutoff frequency around 600 Hz. Capacitor C4, a 15 pF capacitor, suppresses possible high frequency oscillations. The amplified signal from the output of operational amplifier U1A activates a charge pump that is composed of capacitor C5, a 0.1 $\mu$F capacitor, resistor R10, a 200 Ohm resistor, and diodes D1 and D2, for example, model No. lN4148, manufactured by National Semiconductor. This charge pump charges capacitor C6, a 1 $\mu$F capacitor, to a voltage proportional to the amplitude of the signal at the charge pump input. Due to resistor R11, a 10 k Ohm resistor, charge pump has its own band pass characteristic with the center frequency being around 1,000 Hz. Together with the Sallen-Key high pass filter, the charge pump creates the required selectivity of laser detector 116 with a center frequency around 930 Hz. If the voltage across capacitor C6 is large enough, the voltage triggers a Schmitt trigger based on operational amplifier U1B, for example, model No. LM358 manufactured by National Semiconductor. The output of operational amplifier U1B is set HIGH by voltage large enough to trigger the Schmitt trigger. This is an indication that laser radiation is detected. Resistor R12, a 10 k Ohm resistor, and resistor R13, a 10 k Ohm resistor, set the hysteresis of the Schmitt trigger, while resistor R14, a 51 k Ohm resistor, and resistor R15, a 10 k Ohm resistor, set the threshold of the Schmitt trigger. Capacitor C4 suppresses possible false triggering based on short length spikes.

While the vehicle guidance control apparatus of the subject invention is shown in the environment of a toy vehicular apparatus with surface and subsurface vehicles and associated surface and subsurface roadways, the subject invention is equally applicable in a system with a single level of vehicles and roadways. Likewise, while an electromechanical turntable is shown to guide the vehicles through an intersection, other modes of guidance, i.e., electromagnetic, for example, can be employed with the subject invention to control vehicle movement through an intersection.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A control apparatus for guiding toy vehicles on a roadway comprising:

means for generating a vehicle control signal;

means for generating a roadway location signal distinct from the vehicle control signal;

means for receiving a vehicle control signal;

means for receiving a roadway location signal;

means for processing the vehicle control signal generated by said means for generating a vehicle control signal and received by said means for receiving a vehicle control signal to configure a roadway to guide a toy vehicle in one of a number of directions; and means for processing the roadway location signal generated by said means for generating a roadway location signal and received by said means for receiving a roadway location signal to selectively designate at least one of a plurality of locations on a roadway to be configured to guide a toy vehicle based on the control signal generated by said means for generating a vehicle control signal and received by said means for receiving a vehicle control signal.

2. The apparatus of claim 1, wherein said means for generating a vehicle control signal generates an infrared signal and said means for generating a roadway location signal generates a laser signal.

3. The apparatus of claim 1, wherein said means for generating a vehicle control signal and said means for generating a roadway location signal are located in a common hand unit.

4. The apparatus of claim 1, wherein a single means for receiving a vehicle control signal receives all signals from said means for generating a vehicle control signal.

5. The apparatus of claim 1 for guiding toy vehicles on a roadway having a plurality of roads forming roadway intersections, wherein the apparatus includes a separate means for receiving a roadway location signal adjacent each of a plurality of roadway intersections.

6. A control apparatus for guiding toy vehicles on a roadway comprising:

means for generating an omnidirectional vehicle control signal;

means for generating a directionally specific roadway location signal;

means for receiving an omnidirectional vehicle control signal;

means for receiving a directionally specific roadway location signal;

means for processing the omnidirectional vehicle control signal generated by said means for generating an omnidirectional vehicle control signal and received by said means for receiving an omnidirectional vehicle control signal to configure a roadway to guide a toy vehicle in one of a number of directions; and means for processing the directionally specific roadway location signal generated by said means for generating a directionally specific roadway location signal and received by said means for receiving a directionally specific roadway location signal to selectively designate at least one of a plurality of locations on a roadway to be configured to guide a toy vehicle based on the omnidirectional control signal generated by said means for generating an omnidirectional vehicle control signal and received by said means for receiving an omnidirectional vehicle control signal.

7. The apparatus of claim 6, wherein said means for generating an omnidirectional vehicle control signal and said means for generating a directionally specific roadway location signal are located in a common hand unit.

8. The apparatus of claim 6, wherein a single means for receiving an omnidirectional vehicle control signal receives all signals from said means for generating an omnidirectional vehicle control signal.

9. The apparatus of claim 6 for guiding toy vehicles on a roadway having a plurality of roads forming intersections, wherein the apparatus includes a separate means for receiving a directionally specific roadway location signal adjacent each of a plurality of roadway intersections.

10. The apparatus of claim 6, wherein said means for generating a vehicle control signal generates an infrared signal, and said means for generating a roadway location signal generates a laser signal.

11. A control apparatus for guiding toy vehicles on a roadway comprising:

means for generating a vehicle control signal;

means for generating a roadway location signal independent of said means for generating a vehicle control signal;

a single means for receiving all vehicle control signals;

plural means for receiving a roadway location signal;

means for processing the control signal generated by said means for generating a vehicle control signal and received by said means for receiving a vehicle control signal to configure a roadway to guide a toy vehicle in one of a number of directions; and means for processing the roadway location signal generated by said means for generating a roadway location signal and received by at least one of said means for receiving a roadway location signal to selectively designate at least one of a plurality of locations on a roadway to be configured to guide a toy vehicle based on the control signal generated by said means for generating a vehicle control signal and received by said means for receiving a vehicle control signal.

12. The apparatus of claim 11, wherein said means for generating a vehicle control signal generates an infrared signal, and said means for generating a roadway location signal generates a laser signal.

13. The apparatus of claim 11, wherein said means for generating a vehicle control signal and said means for generating a roadway location signal are located in a common hand unit.

14. The apparatus of claim 11 for guiding toy vehicles on a roadway having a plurality of roads forming roadway intersections, wherein the apparatus includes a separate means for receiving a roadway location signal adjacent each of a plurality of roadway intersections.

15. A control apparatus for guiding toy vehicles on a roadway having a plurality of roads forming intersections comprising:

means for generating a vehicle control signal;

means for generating a roadway location signal distinct from the vehicle control signal;

means for receiving a vehicle control signal, separate means for receiving a roadway location signal adjacent each of a plurality of roadway intersections;

means for processing the control signal generated by said means for generating a vehicle control signal and received by said means for receiving a vehicle control signal to configure a roadway to guide a toy vehicle in one of a number of directions; and means for processing the roadway location signal generated by said means for generating a roadway location signal and received by at least one of said means for receiving a roadway location signal to selectively designate at least one of a plurality of locations on a roadway to be configured to guide a toy vehicle based on the control signal generated by said means for generating a vehicle control signal and received by said means for receiving a vehicle control signal.

16. The apparatus of claim 15, wherein said means for generating a vehicle control signal generates an infrared signal, and said means for generating a roadway location signal generates a laser signal.

17. The apparatus of claim 15, wherein said means for generating a vehicle control signal and said means for generating a roadway location signal are located in a common hand unit.

18. The apparatus of claim 15, wherein a single means for receiving a vehicle control signal receives all signals from said means for generating a vehicle control signal.

19. A control apparatus for guiding toy vehicles on a roadway comprising:

means for selectively generating one of a plurality of vehicle control signals;

means for generating a roadway location signal;

means for receiving a vehicle control signal;

means for receiving a roadway location signal;

means for processing the vehicle control signal generated by said means for generating a vehicle control signal and received by said means for receiving a vehicle control signal, said means for processing the vehicle control signal processes said vehicle control signal to selectively configure a roadway in one of a number of configurations to guide a toy vehicle in one of a number of directions, each vehicle control signal corresponding to a respective different configuration of the roadway, the selected roadway configuration being selected on the basis of the selected vehicle control signal; and means for processing the roadway location signal generated by said means for generating a roadway location signal and received by said means for receiving a roadway location signal to selectively designate at least one of a plurality of locations on a roadway to be configured to guide a toy vehicle based on the control signal generated by said means for generating a vehicle control signal and received by said means for receiving a vehicle control signal.

20. A control apparatus for guiding toy vehicles on a roadway comprising:

means for generating a vehicle control signal carrying location-independent vehicle control information;

means for generating a directionally specific roadway location signal;

means for receiving a vehicle control signal;

means for receiving a directionally specific roadway location signal;

means for processing the vehicle control signal generated by said means for generating a vehicle control signal and received by said means for receiving a vehicle control signal to configure a roadway to guide a toy vehicle in one of a number of directions; and means for processing the directionally specific roadway location signal generated by said means for generating a directionally specific roadway location signal and received by said means for receiving a directionally specific roadway location signal to selectively designate at least one of a plurality of locations on a roadway to be configured to guide a toy vehicle based on the control signal generated by said means for generating a vehicle control signal and received by said means for receiving a vehicle control signal.

21. A control apparatus for guiding toy vehicles on a roadway comprising:

means for generating a vehicle control signal;

means for generating a roadway location signal;

a single means for receiving all vehicle control signals;

plural means for receiving a roadway location signal;

means for processing the control signal generated by said means for generating a vehicle control signal and received by said means for receiving a vehicle control signal to configure a roadway to guide a toy vehicle in one of a number of directions; and means for processing the roadway location signal generated by said means for generating a roadway location signal and received by at least one of said means for receiving a roadway location signal to selectively designate at least one of a plurality of locations on a roadway to be configured to guide a toy vehicle based on the control signal generated by said means for generating a vehicle control signal and received by said means for receiving a vehicle control signal, wherein said means for generating a vehicle control signal generates an infrared signal, and said means for generating a roadway location signal generates a laser signal.

* * * * *